US008366290B2

(12) United States Patent
Maglica

(10) Patent No.: US 8,366,290 B2
(45) Date of Patent: Feb. 5, 2013

(54) PORTABLE LIGHTING DEVICE

(75) Inventor: Anthony Maglica, Ontario (CA)

(73) Assignee: Mag Instrument, Inc., Ontario (CA)

( * ) Notice: Subject to any disclaimer, the term of this patent is extended or adjusted under 35 U.S.C. 154(b) by 412 days.

(21) Appl. No.: 12/353,965

(22) Filed: Jan. 14, 2009

(65) Prior Publication Data

US 2010/0177508 A1 Jul. 15, 2010

(51) Int. Cl.
*F21L 4/04* (2006.01)
*F21V 19/02* (2006.01)

(52) U.S. Cl. ..... 362/202; 362/197; 362/205; 362/285

(58) Field of Classification Search ..... 362/197, 362/199, 202–206, 294, 345, 373, 187, 188, 362/285, 287, 421
See application file for complete search history.

(56) References Cited

U.S. PATENT DOCUMENTS

| | | | | |
|---|---|---|---|---|
| 1,142,964 | A | | 6/1915 | Howe |
| 1,513,211 | A | | 10/1924 | Barany |
| 1,584,539 | A | | 5/1926 | Hopkins |
| 1,603,272 | A | | 10/1926 | Eaton |
| 1,608,195 | A | | 11/1926 | Barany |
| 1,610,289 | A | | 12/1926 | Jones |
| 1,634,399 | A | * | 7/1927 | Dake ..... 362/294 |
| 1,638,716 | A | | 8/1927 | Surles |
| 1,644,126 | A | | 10/1927 | Harris |
| 1,674,650 | A | | 6/1928 | Leser |
| 1,680,169 | A | | 8/1928 | Osean |
| 1,758,835 | A | | 5/1930 | Hime |
| 1,851,503 | A | | 3/1932 | Flamm |
| 1,932,102 | A | | 10/1933 | Eaton |
| 2,016,819 | A | | 10/1935 | Meginniss |
| 2,097,222 | A | | 10/1937 | Tompkins |
| 2,107,599 | A | | 2/1938 | Chan |
| 2,173,650 | A | | 9/1939 | Fullmer |
| 2,176,301 | A | | 10/1939 | Haas |
| 2,212,103 | A | | 8/1940 | Rothenberg et al. |
| 2,264,284 | A | | 12/1941 | Bassett |
| 2,272,907 | A | | 2/1942 | Deibel |
| 2,339,356 | A | | 1/1944 | Sachs |
| 2,490,830 | A | | 12/1949 | Norton |
| 2,530,913 | A | | 11/1950 | Shackel |
| 2,599,295 | A | | 6/1952 | Thomas |

(Continued)

FOREIGN PATENT DOCUMENTS

| | | |
|---|---|---|
| AU | 114558 | 1/1942 |
| AU | 138873 | 4/1948 |

(Continued)

OTHER PUBLICATIONS

PCT International Search Report for International Application No. PCT/US10/00082 (related to U.S. Appl. No. 12/353,965), Mar. 8, 2010.

(Continued)

*Primary Examiner* — Alan Cariaso

(57) ABSTRACT

A flashlight having a main power circuit and a barrel is disclosed. The main power circuit includes a light source and a portable power source for supporting the light source. The barrel is not within the main power circuit. The flashlight also has a ball for holding the light source. The light source is fit and in contact with the inner surface of the ball. The outer circumference of the ball has an array of fin-like protrusions for effectively dissipating heat from the light source.

20 Claims, 16 Drawing Sheets

U.S. PATENT DOCUMENTS 2,796,516 A * 6/1957 Martschik ..... 362/199
2,915,621 A 12/1959 Garland
2,931,005 A 3/1960 Saurwein
2,945,944 A 7/1960 Gillespie
3,014,125 A 12/1961 Draudt
3,076,891 A 2/1963 Moore
3,314,331 A 4/1967 Wiley
3,469,140 A 9/1969 Bottone et al.
3,622,832 A 11/1971 Schlessel et al.
3,652,846 A 3/1972 Starck, II
3,997,808 A 12/1976 Wojtowicz
4,114,187 A 9/1978 Uke
4,151,583 A 4/1979 Miller
4,156,271 A 5/1979 Vercellotti
4,171,534 A 10/1979 Strowe
4,176,263 A 11/1979 Rousseau
4,203,150 A 5/1980 Shamlian
4,234,913 A 11/1980 Ramme
4,261,026 A 4/1981 Bolha
4,286,311 A 8/1981 Maglica
4,287,448 A 9/1981 Bradley
4,329,740 A 5/1982 Colvin
4,388,673 A 6/1983 Maglica
4,398,232 A 8/1983 Elmore
4,398,238 A 8/1983 Nelson
4,429,351 A 1/1984 Petzl et al.
4,464,600 A 8/1984 Kosmatka et al.
4,472,766 A 9/1984 Hung
4,495,551 A 1/1985 Foltz
4,527,223 A 7/1985 Maglica
4,531,178 A 7/1985 Uke
4,570,208 A 2/1986 Sassmannshausen
4,577,263 A 3/1986 Maglica
4,581,686 A 4/1986 Nelson
4,644,220 A 2/1987 Carley
4,656,565 A 4/1987 Maglica
4,658,336 A 4/1987 Maglica
4,695,551 A 9/1987 Samhaber et al.
4,725,932 A 2/1988 Gammache
4,733,337 A 3/1988 Bieberstein
4,777,582 A 10/1988 Sharrah
4,819,141 A 4/1989 Maglica et al.
4,841,417 A 6/1989 Maglica et al.
4,843,526 A 6/1989 Price, III
4,864,474 A 9/1989 Maglica
4,888,670 A 12/1989 Sharrah
4,899,265 A 2/1990 Maglica
4,942,505 A 7/1990 Maglica
4,951,183 A 8/1990 Wang
4,967,325 A 10/1990 Shiau
5,003,440 A 3/1991 Maglica
5,113,326 A 5/1992 Maglica
5,121,308 A 6/1992 Maglica et al.
5,122,935 A 6/1992 Peterson
5,126,927 A 6/1992 Reeves et al.
5,138,537 A 8/1992 Wang
5,158,358 A 10/1992 Maglica et al.
5,207,502 A 5/1993 Maglica
5,260,858 A 11/1993 Maglica
5,293,307 A 3/1994 Maglica
5,349,506 A 9/1994 Maglica
5,459,649 A 10/1995 Ellion
5,461,552 A 10/1995 Tillery
5,535,107 A 7/1996 Prok
5,560,705 A 10/1996 Shiau
5,590,951 A * 1/1997 Matthews ..... 362/205
5,593,222 A 1/1997 Maglica
5,601,359 A 2/1997 Sharrah et al.
5,738,434 A * 4/1998 Sun ..... 362/199
5,769,525 A 6/1998 Daumueller et al.
5,806,964 A 9/1998 Maglica
5,826,971 A 10/1998 Kibler
5,826,972 A 10/1998 Chiu
5,865,525 A 2/1999 Kibler et al.
5,959,306 A 9/1999 Kalley et al.
5,999,749 A 12/1999 Kobayashi et al.
6,074,072 A 6/2000 Parsons et al.
6,161,938 A * 12/2000 Kish et al. ..... 362/183
6,170,960 B1 1/2001 Maglica
6,183,106 B1 2/2001 Thummel et al.
6,193,389 B1 2/2001 Maglica
6,206,539 B1 3/2001 Ko
6,347,878 B1 2/2002 Shiao
6,386,732 B1 5/2002 Shiau
6,388,885 B1 5/2002 Alexander et al.
6,390,653 B1 * 5/2002 Schrewe ..... 362/374
6,394,629 B1 5/2002 Kobayashi et al.
6,561,675 B1 * 5/2003 Kavanagh ..... 362/263
6,722,772 B2 4/2004 Maglica
6,726,342 B1 * 4/2004 Lai ..... 362/188
6,979,100 B2 * 12/2005 Reiff et al. ..... 362/294
7,264,372 B2 9/2007 Maglica
7,309,139 B2 * 12/2007 Au et al. ..... 362/188
7,334,914 B2 2/2008 Maglica
7,344,269 B2 3/2008 Maglica
7,738,235 B2 * 6/2010 Gloisten et al. ..... 361/173
7,744,259 B2 * 6/2010 Walczak et al. ..... 362/421
7,909,478 B2 * 3/2011 Dallas ..... 362/202
2005/0024864 A1 2/2005 Galli
2005/0207148 A1 9/2005 Maglica
2006/0114669 A1 6/2006 Maglica
2006/0120069 A1 6/2006 West

FOREIGN PATENT DOCUMENTS

EP 1037154 9/2000
FR 887248 11/1943
FR 2372382 6/1978
GB 292836 6/1928
GB 411218 6/1934
GB 549104 11/1942
GB 752619 7/1956
GB 812980 5/1959
GB 830221 3/1960
GB 2107038 4/1983
JP 5-14620 11/1930
JP 14-19704 12/1939
TW 578888 3/2004
WO WO 93/16323 8/1993
WO WO 02/33310 4/2002

OTHER PUBLICATIONS

PCT Written Opinion of the International Searching Authority for International Application No. PCT/US10/00082 (related to U.S. Appl. No. 12/353,965), Mar. 8, 2010.
European Search Report dated Apr. 22, 2008 for European Application No. EP 05 72 4993.

* cited by examiner

PORTABLE LIGHTING DEVICE

TECHNICAL FIELD

The present invention relates to portable lighting devices, including for example, flashlights and headlamps, and their circuitry.

BACKGROUND

Various hand held or portable lighting devices, including flashlights, are known in the art. Such lighting devices typically include one or more dry cell batteries having positive and negative electrodes. The batteries are arranged electrically in series or parallel in the battery compartment or a housing. The battery compartment also sometimes functions as the handle for the lighting device, particularly in the case of flashlights where a barrel contains the batteries and is also used to hold the flashlight. An electrical circuit is frequently established from a battery electrode through conductive means which are electrically coupled with an electrode of a light source, such as a lamp bulb or a light emitting diode ("LED"). After passing through the light source, the electric circuit continues through a second electrode of the light source in electrical contact with conductive means, which in turn are in electrical contact with the other electrode of a battery. Typically, the circuit includes a switch to open or close the circuit. Actuation of the switch to close the electrical circuit enables current to pass through the lamp bulb, LED, or other light source—and through the filament, in the case of an incandescent lamp bulb—thereby generating light.

In metal flashlights, it has also been conventional to use the barrel and the tail cap as a portion of the conductive means of the electrical circuit. However, in order to increase corrosion resistance and aesthetics of aluminum flashlights, the head, barrel, and tail cap are usually anodized. As a result, either a skin cut to remove anodizing on the inner mating surfaces of the barrel and the tail cap are required to provide a conductive path between the barrel (and the tail cap) and the other portion(s) of the electrical circuit, or the relevant contacting portions must be masked prior to anodizing so that they are not anodized in the first place. Either approach requires additional manufacturing steps, which in turn increases manufacturing costs. Further, the unprotected portions of aluminum or aluminum alloy are more susceptible to corrosion.

Some flashlights designs have proposed the use of a ball to hold the light source of the flashlight within a ball housing to allow the light source to be adjusted with respect to the principal axis of a reflector. Such flashlights, however, do not provide a configuration that suitably addresses the thermal management issues created by today's high power, high brightness LEDs.

Some advanced portable lighting devices provide multiple functions for different needs. For example, a power saving mode and/or an SOS mode may be implemented in a flashlight or other portable lighting devices in addition to the normal "full power" mode. In such portable lighting devices, the user typically elects the desired mode of operation by manipulation of the main power switch. For example, when the flashlight is in the normal mode or the power save mode of operation, the flashlight may be transitioned to another mode of operation, such as an SOS mode by manipulating the main power switch to momentarily turn off and then turn back on the flashlight.

Typically the functionality of multi-mode portable lighting devices of this sort is provided by a microcontroller, which remains powered by the batteries at all times. As a result, the volatile memory of the microcontroller may be used to store the current mode of the flashlight, and thus determine which mode to transition into in the event that a user enters the proper command signal. However, if the portable lighting device—particularly in the case of larger flashlights—is accidentally hit against, or dropped on, a hard surface, the inertia of the battery or batteries may cause the battery or batteries to disconnect from one of the battery contacts for a short period of time. This disconnection will also cause a power loss to the microcontroller, thereby causing the microcontroller to lose track of the mode the flashlight or other lighting device was in prior to the power loss. As a result, the microcontroller will reset the flashlight or other lighting device to its default mode, which is typically off, rather than automatically returning to the prior mode of operation. Resetting under such circumstances is undesirable and potentially hazardous.

Portable lighting devices that include advanced functionality typically include a printed circuit board with a microcontroller or microprocessor to provide the desired functionality. A need exists, however, for a push button switch assembly that includes an integral circuit board that may be readily employed in a variety of portable lighting devices to provide multiple levels of functionality to the same.

In view of the foregoing, a need exists for an improved portable lighting device that addresses or at least ameliorates one or more of the problems discussed above.

SUMMARY

It is an object of the present invention to address or at least ameliorate one or more of the problems associated with flashlights and/or portable lighting devices noted above. Accordingly, in a first aspect of the invention, a portable lighting device with a light source and a portable power source for powering the light source is provided.

In one embodiment, the portable lighting device has a portable power source having an anode and a cathode, a light source having a positive electrode and a negative electrode, a first spring, a second spring, and a housing for holding the portable power source. The first spring may be located between the light source and the portable power source for forming a first portion of a first electrical path between the positive electrode of the light source and the cathode of the portable power source. The second spring may be located between the light source and the portable power source for forming a first portion of a second electrical path between the negative electrode of the light source and the anode of the portable power source. The housing of the portable lighting device preferably does not form part of the first or second electrical paths.

In another embodiment, the portable lighting device has a main power circuit, a first spring, a second spring, and a barrel. The main power circuit includes a portable power source and a light source. The portable power source has an anode and a cathode. The light source has a positive electrode and a negative electrode. The first spring is within the main power circuit and electrically connects the positive electrode of the light source and the cathode of the portable power source. The second spring is within the main power circuit and electrically connects the negative electrode of the light source and the anode of the portable power source. While the barrel is configured to hold the portable power source, it does not form part of the main power circuit.

In a second aspect, a portable lighting device with a light source and an adjustable ball for holding the light source is provided.

In one embodiment, the portable lighting device comprises a main power circuit including a portable power source, a reflector, a light source, and an ball assembly including a metal ball for adjustably holding the light source relative the principal axis of a reflector. The outer surface of the ball includes one or more cooling fins for dissipating heat from the light source. In another embodiment, a plastic adjustment ring is preferably molded around the ball to form a unitary ball assembly for adjusting the light source relative to the principal axis of a reflector.

In another aspect, an adjustable ball assembly for a portable lighting device is provided. In one embodiment, the adjustable ball assembly has a metal tubular housing, a ball assembly, a lighting module, a funnel spring and a ball retainer. The metal tubular ball housing may have a forward end, a rearward end, and a slot on the rearward end. The ball assembly is configured to fit within the forward end of the metal tubular ball housing. A ball of the ball assembly preferably has an annular hollow region, sized to receive the lighting module. The retainer is configured to fit within the aft end of the metal tubular ball housing. The retainer may have an annular channel region that is configured to receive a tail end of funnel spring there through. A head end of the funnel spring is larger in diameter than the annular channel region of the retaine and is interposed between the retainer and the forward contact cup.

In another embodiment, the adjustable ball assembly for portable lighting devices has a metal tubular ball housing, a ball assembly, a lighting module, a retainer, a insulator, and a funnel spring having a head. The metal tubular ball housing has a front end and a rear end. The ball assembly has an annular hollow region in which the assembly slideably fits. The ball assembly includes a central through hole. The lighting module can be partially fit within the adjustable ball assembly. The retainer can have a through hole and a front open mouth. The diameter of the front open mouth is smaller than that of the annular hollow region of the ball assembly. The retainer can be fit within the rearward end of the metal tubular ball housing so that the front open mouth of the retainer defines a rear-most position. The insulator can be located between the lighting module and the retainer. The insulator can have a cup-shaped receiving area to receive the head of the funnel spring. The receiving area defines a front-most position. The diameter of the head of the funnel spring is larger than the front open mouth of the retainer. The head of the funnel spring can be confined between the front-most position and the rear-most position.

Further aspects, objects, and desirable features, and advantages of the invention will be better understood from the following description considered in connection with the accompanying drawings in which various embodiments of the disclosed invention are illustrated by way of example. It is to be expressly understood, however, that the drawings are for the purpose of illustration only and are not intended as a definition of the limits of the invention.

DETAILED DESCRIPTION

Figure 1:
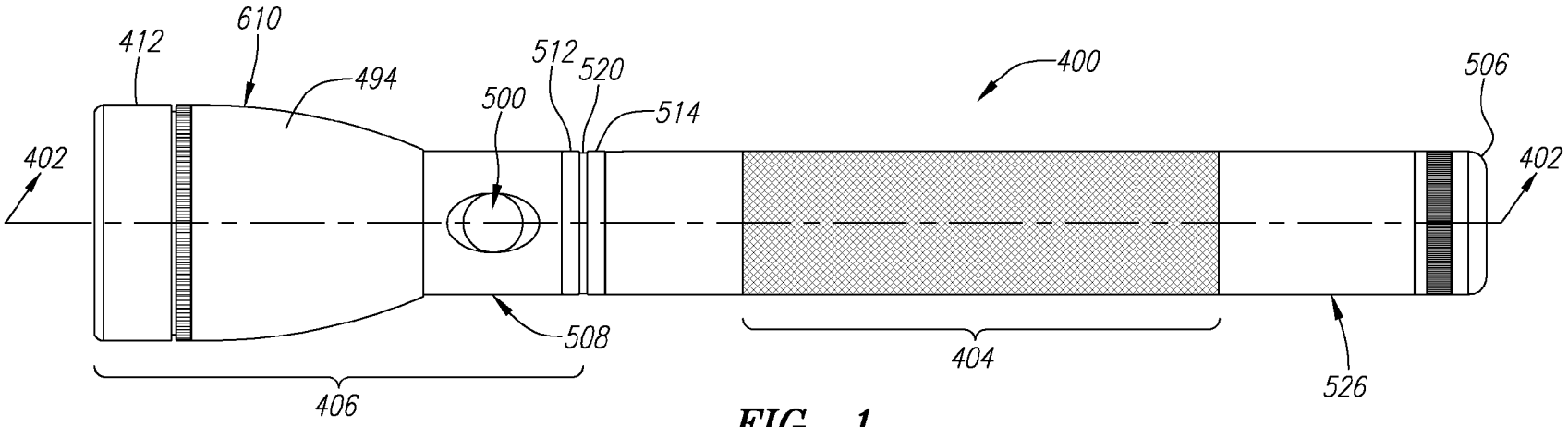
FIG. 1 is a top view of a portable lighting comprising a flashlight according to one embodiment of the present invention.

Embodiments of the invention will now be described with reference to the drawings. To facilitate the description, any reference numeral representing an element in one figure will represent the same element in any other figure. Further, in the description that is to follow, upper, front, forward or forward facing side of a component shall generally mean the orientation or the side of the component facing the direction toward the front end of the portable lighting device or flashlight. Similarly, lower, aft, back, rearward or rearward facing side of a component shall generally mean the orientation or the side of the component facing the direction toward the rear of the portable lighting device (e.g., where the tail cap is located in the case of a flashlight).

Flashlight 400 according to one embodiment of the present invention is described in connection with FIGS. 1-9 below. Flashlight 400 incorporates a number of distinct aspects of the present invention. While these distinct aspects have all been incorporated into the flashlight 400 in various combinations, it is to be expressly understood that the present invention is not restricted to flashlight 400 described herein. Rather, the present invention is directed to each of the inventive features of the flashlight 400 described below, both individually as well as collectively, in various embodiments. Further, as will become apparent to those skilled in the art after reviewing the present disclosure, one or more aspects of the present invention may also be incorporated into other portable lighting devices, including, for example, head lamps.

Figure 2:
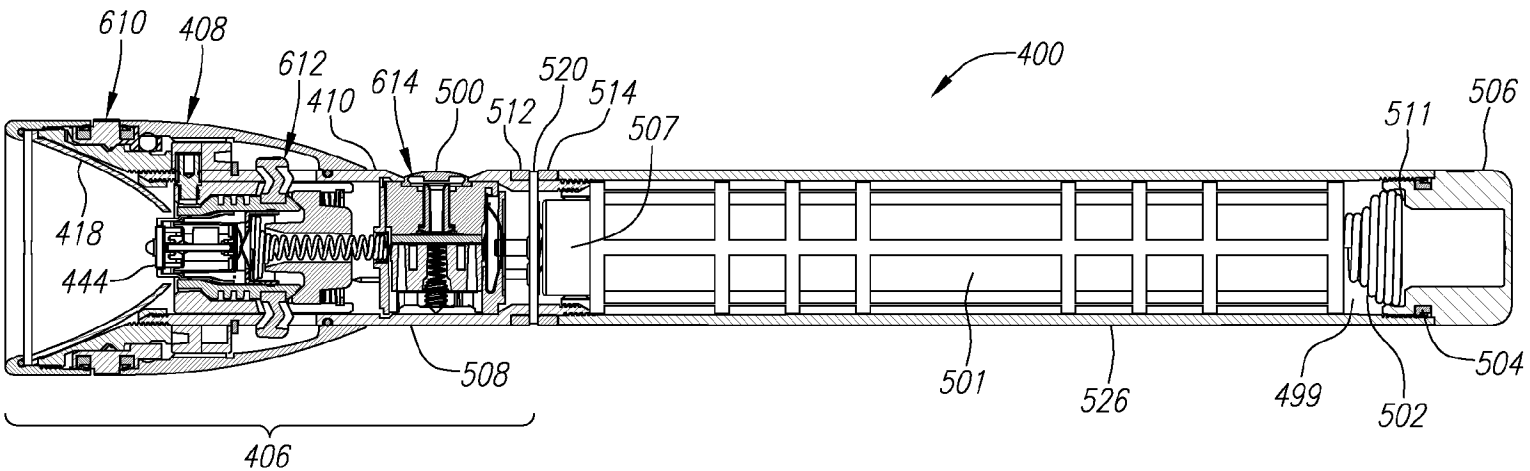
FIG. 2 is a cross-sectional view of the flashlight of FIG. 1 taken along the plane indicated by 402-402.

Referring to FIGS. 1-2, flashlight 400 includes a head assembly 610, a front barrel 508 a rear barrel 526, a tail cap 506, a switch 500, and charging contacts 512 and 514. In the present embodiment, the front barrel 508 and the rear barrel 526 are joined together near where the external charging contacts 512 and 514 are provided to form a uniform cylinder body. The aft end of the rear barrel 526 is enclosed by the tail cap 506 while the forward end of the front barrel 508 is enclosed by the head assembly 610.

Front and rear barrels 508, 526 are preferably made out of metal, more preferably aluminum. Rear barrel 526 may be provided with a textured surface 404 along a portion of its axial extent, preferably in the form of machined knurling. A portion of front barrel 508 extends beneath a head skirt 494 of the head assembly 610. A hollow space 499 is formed within rear barrel 526 for housing a portable power source, such as a battery pack 501.

In the present embodiment, battery pack 501 comprises two lithium-ion batteries physically disposed in a series arrangement, while being electrically connected in parallel. The structure of one battery pack that may be used as battery pack 501 is more fully described in co-pending U.S. patent application Ser. No. 12/353,820, which is hereby incorporated by reference.

Battery pack 501 has a front end 507 having a reduced diameter in comparison to the remainder of the battery pack 501. This arrangement prevents battery pack 501 from being inserted in a reverser manner, thereby protecting battery pack 501 as well as the flashlight 400. Further, as shown best in FIG. 4, a cathode (or positive electrode) 503 and an anode (or negative electrode) 505 are both provided on the front end 507 of the battery pack 501 for added safety.

While a lithium-ion battery pack 501 is used as the portable power source for the illustrated embodiment of flashlight 400, in other embodiments, other portable power sources may also be employed, including, for example, dry cell batteries, rechargeable batteries, or battery packs comprising two or more batteries physically disposed in a parallel or side-by-side arrangement, while being electrically connected in series or parallel depending on the design requirements of the flashlight. Other suitable portable power sources, including, for example, high capacity storage capacitors may also be used.

Tail cap 506 is also preferably made out of aluminum and is configured to engage mating threads provided on the interior of rear barrel 526 as is conventional in the art. However, other suitable means may also be employed for attaching tail cap 506 to rear barrel 526. A one-way valve 504, such as a lip seal, may be provided at the interface between tail cap 506 and rear barrel 526 to provide a watertight seal while simultaneously allowing overpressure within the flashlight to expel or vent to atmosphere. However, as those skilled in the art will appreciate, other forms of sealing elements, such as an O-ring, may be used instead of one-way valve 504 to form a watertight seal. The design and use of one-way valves in flashlights is more fully described in U.S. Pat. No. 5,113,326 to Anthony Maglica, which is hereby incorporated by reference.

In the present embodiment, spring 502 is seated in a spring seat 511 provided on the forward end of tail cap 506. Spring 502 urges battery pack 501 forward so that electrodes 503, 505 on the front end 507 of battery pack 501 come into contact with cathode contact 523 and anode contact 525, respectively, provided on the aft side of charger circuit board 520. Contacts 523, 525 are preferably soldered to the aft side of charger circuit board 520.

If made out of aluminum, the surfaces of front barrel 508, rear barrel 526 and tail cap 506 are preferably anodized to prevent corrosion. While in the present embodiment, barrels 508, 526 and tail cap 506 do not form part of the electrical circuit of the flashlight 400, in other embodiments, one or more of the front barrel 508, rear barrel 526, or tail cap 506 may form part of the electrical circuit of the flashlight. In such embodiments, those surfaces used to make electrical contact with another metal surface should either not be anodized or a skin cut to remove anodizing should be made following anodization for purposes of establishing the electrical circuit in the assembled flashlight.

External charging contacts 512 and 514 are provided at the rearward section of front barrel 508. While charging contacts 512 and 514 are provided in the present embodiment in the form of charging rings to simplify the recharging procedure, in other embodiments charging contacts 512 and 514 may take on other forms.

In the present embodiment, a charger circuit board 520 is interposed between charging contacts 512 and 514. Charger circuit board 520 is configured to be in electrical communication with charging contacts 512 and 514, while simultaneously isolating charging contacts 512 and 514 from direct electrical communication with one another through a short circuit. Electrical communication between charger circuit board 520 and charging contacts 512 and 514 may be established by providing a conductive trace on the charger circuit board 520.

Charger circuit board 520 may include, for example, a charge protection circuit, a charge control circuit, and a battery protection circuit. The charge protection circuit may be used to continuously monitor the battery voltage. The charge control circuit may be used to charge the battery pack 501. The battery protection circuit may be used to further protect the battery pack 501 from over charging, over discharging, or over current.

Referring to FIGS. 1-4, the present embodiment includes a head 420 to which a number of other components may be mounted, including, for example, skirt lock ring 426, wave spring 422, head skirt 494, face cap 412, lens 416, and reflector 418 to form a head assembly 610. Head 420, skirt lock ring 426, head skirt 494 and face cap 412 are preferably made from anodized aluminum. On the other hand, reflector 418 is preferably made out of injection molded plastic. The interior surface of reflector 418 is preferably metallized to enhance its reflectivity to a suitable level.

In the present embodiment, head 420 is a hollow support structure comprising a front section 516, a midsection 518 and an aft section 530. Head 420 is internally disposed in the present embodiment in that head 420 is covered by face cap 412, skirt lock ring 426, and head skirt 494 when the flashlight 400 is fully assembled. In other words, in the present embodiment, head 420 does not comprise an external portion of the flashlight 400. The front section 516 comprises a generally cup-shaped receiving area 532 for receiving reflector 418. The midsection 518, which extends rearward from the front section 516, includes a generally cup-shaped receiving area 534. And, the aft section 530, which extends rearward from the midsection 518, includes internal threads 536 which are configured to mate with external threads 497 on the forward end of front barrel 508. Head 420 is locked to the front barrel 508 with a retainer 432. Retainer 432 is externally threaded with threads 540 on its aft end and is outwardly tapered on its forward end. Retainer 432 is configured so that external threads 540 mate with internal threads 495 provided on the forward end of front barrel 508.

Because front barrel 508 includes opposing slots 411, when retainer 432 is threaded into threads 425 of front barrel 508, front barrel 508 is expanded as the tapered portion of retainer 432 contacts front barrel 508 and is then screwed further into the front barrel 508. When retainer 432 is fully seated in front barrel 508, head 420 is locked to the front barrel 508.

Figure 3:
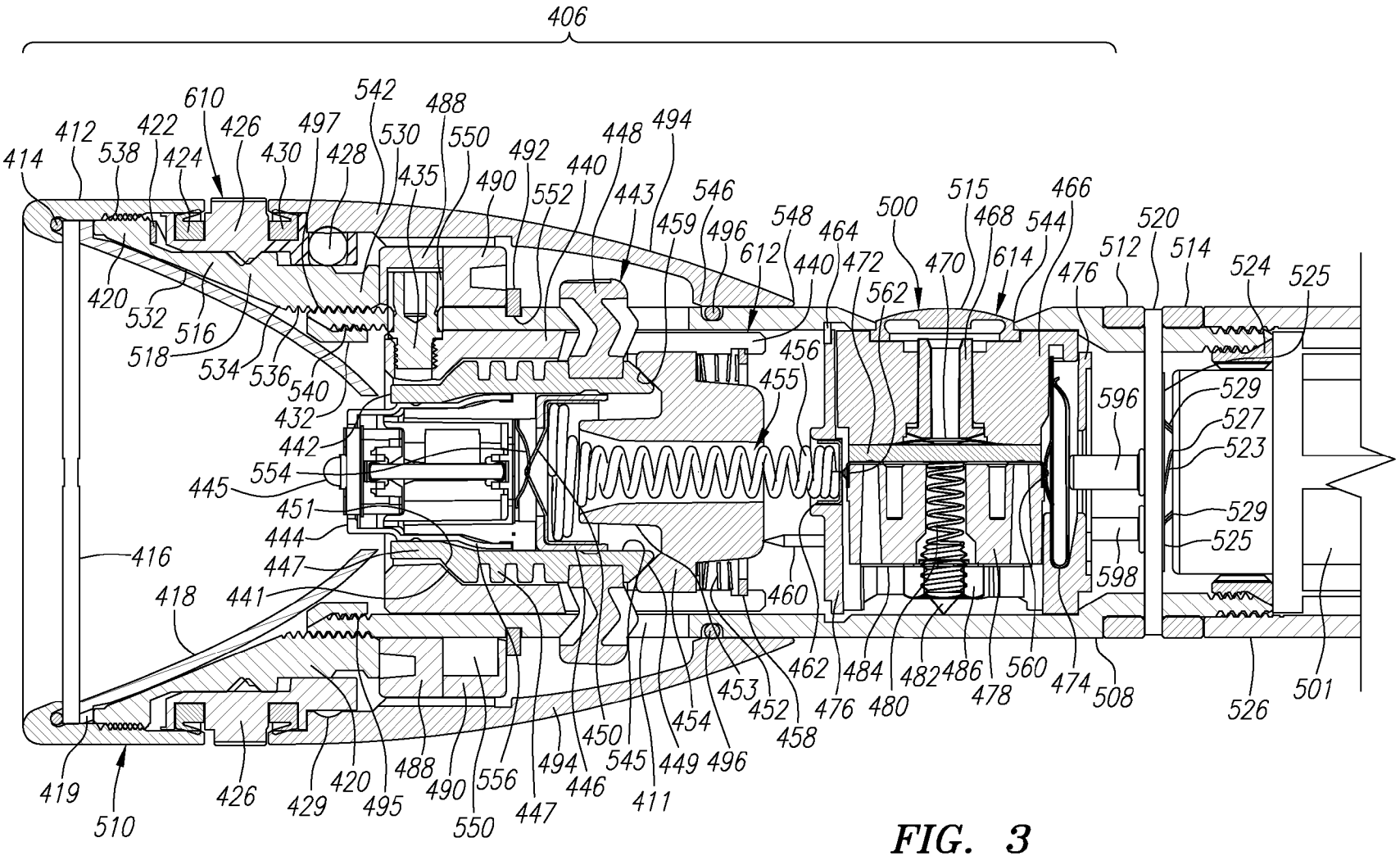
FIG. 3 is an enlarged cross-sectional view of the forward section of the flashlight of FIG. 1 taken through the plane indicated by 402-402.

The face cap 412 retains lens 416 and reflector 418 relative to the head 420 and reflector 418. In the present embodiment, face cap 412 is configured to thread onto external threads 238 provided on the front section 516 of the head 420. In other implementations, however, other forms of attachment may be adopted. An O-ring 114 is provided at the interface between face cap 412 and lens 416 to provide a watertight seal. As best seen in FIG. 3, reflector 418 is positioned within the cup-shaped receiving area 532 of head 420 so that it is disposed forward of the head 420 and retainer 432. The internal surface of the cup-shaped receiving area 532 together with the outer surface of reflector 418 and reflector flange 419 ensure the proper alignment of the principal axis of reflector 418 with the central axis of the front barrel 508. The face cap 412 in turn clamps O-ring 414, lens 416, and reflector 418, via reflector flange 419, to head 420.

Head skirt 494 has a diameter greater than that of the front and rear barrels 508, 526. Head skirt 494 is also adapted to pass externally over the exterior of the front and rear barrels 508, 526. The forward end 542 of head skirt 494 is configured to mate with the outer surface of a skirt lock ring 426 at selected locations to properly position head skirt 494 relative to face cap 412 and head 420.

Figure 5A:
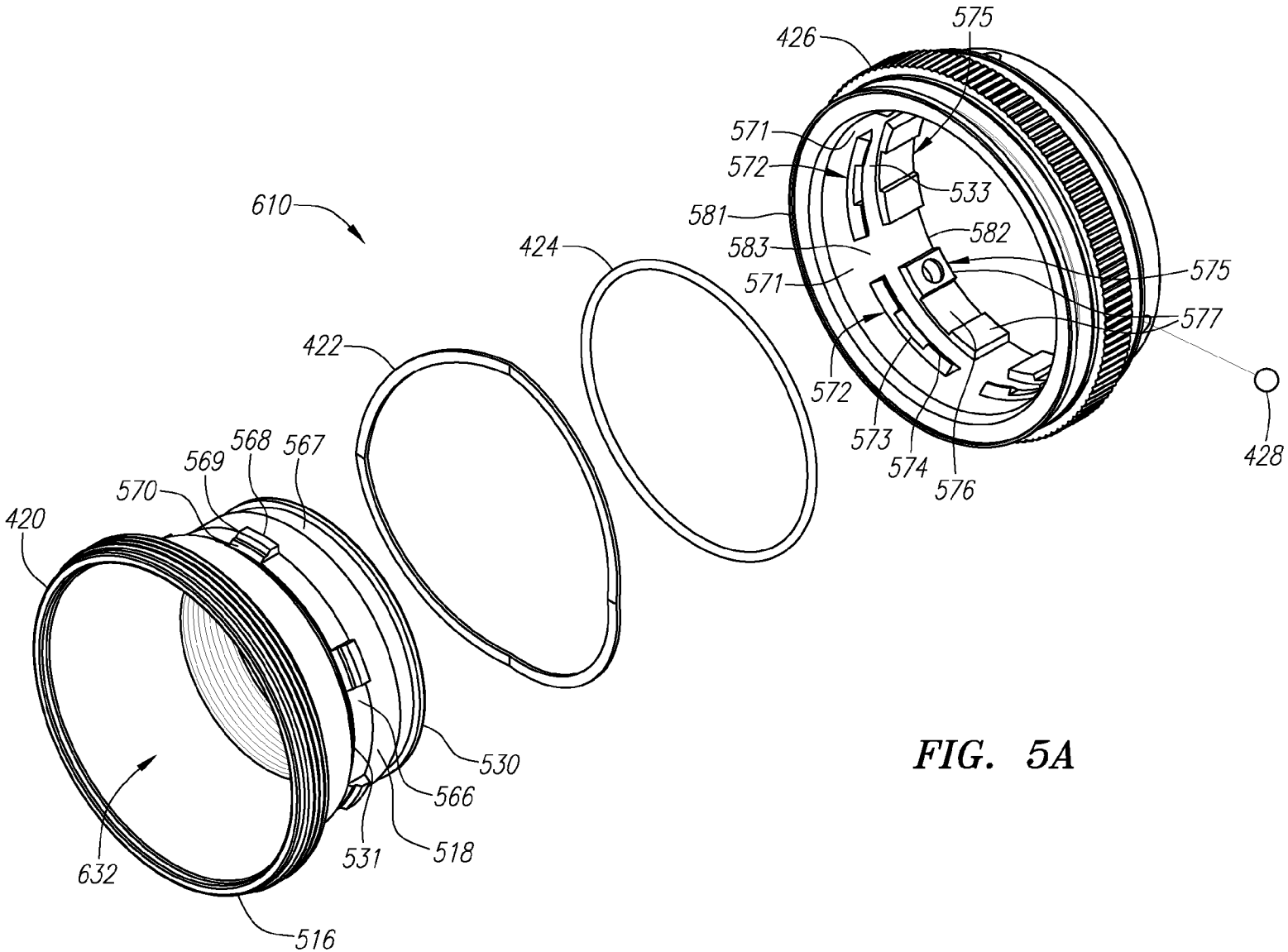
FIG. 5A is an enlarged exploded perspective view of a portion of the head assembly of the flashlight of FIG. 1.

The locking mechanism of the head skirt 494 will now be described. FIG. 5A shows an exploded view of a portion of head assembly 610. The outer surface of head 420 has a nominally smooth surface 566 with an annular groove 567 on the outer surface of aft section 530 and a plurality of protuberances 568 equally spaced from each other around the outer circumference of the midsection 518 of head 420.

FIGS. 6A through 6I are cross-sectional views illustrating different relative positions between the head 420 and skirt lock ring 426. The dimensions of the head 420 and skirt lock ring 426 in FIGS. 6A through 6I are not to scale. Nevertheless, FIGS. 6A-6I are helpful for the purpose of illustrating how the locking mechanism of head skirt 494 works in the illustrated embodiment.

Figure 6A:
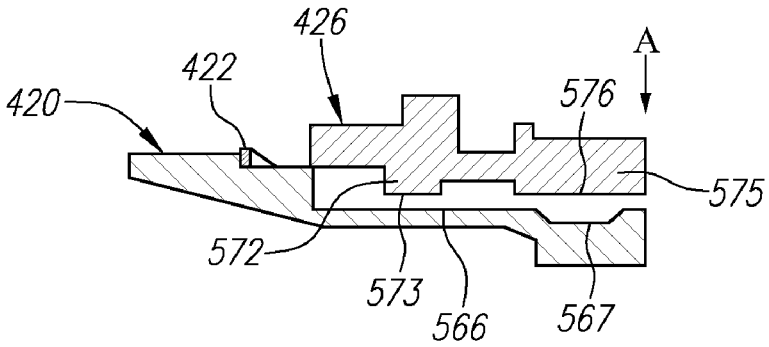
FIGS. 6A through 6C are different cross-sectional views illustrating one relative position between the skirt lock ring and head.
Figure 6B:
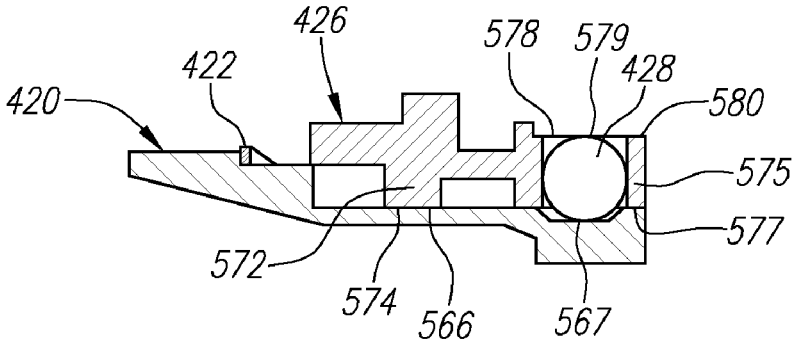
Figure 6C:
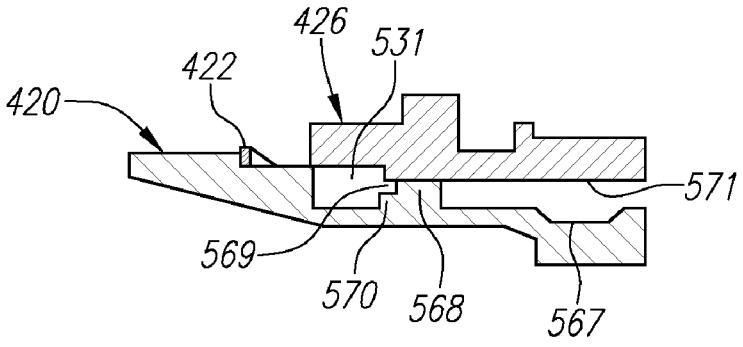
Figure 6D:
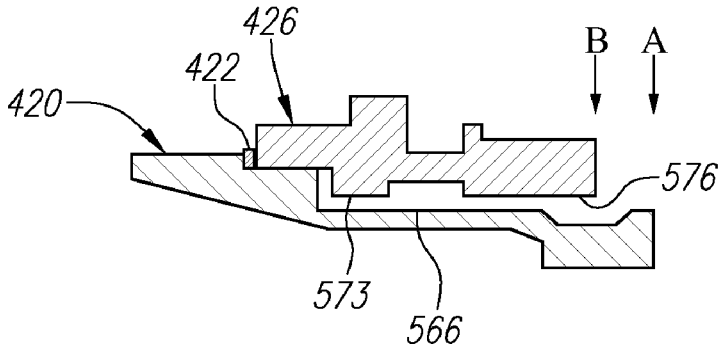
FIGS. 6D through 6F are different cross-sectional views illustrating a second relative position between the skirt lock ring and head.
Figure 6E:
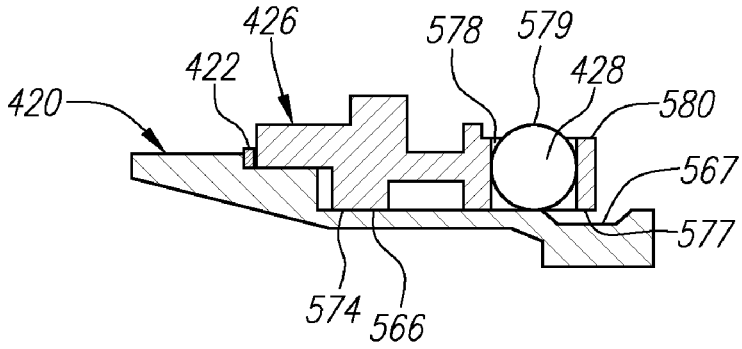
Figure 6F:
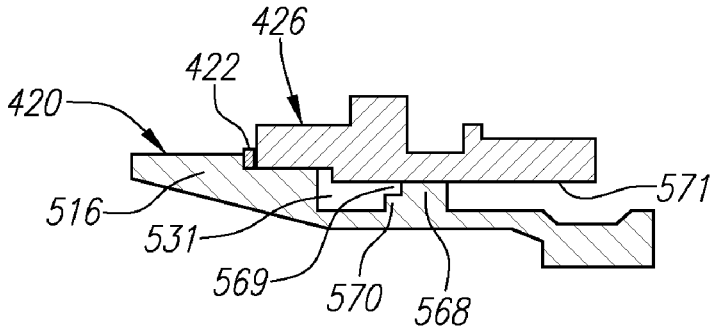
Figure 6G:
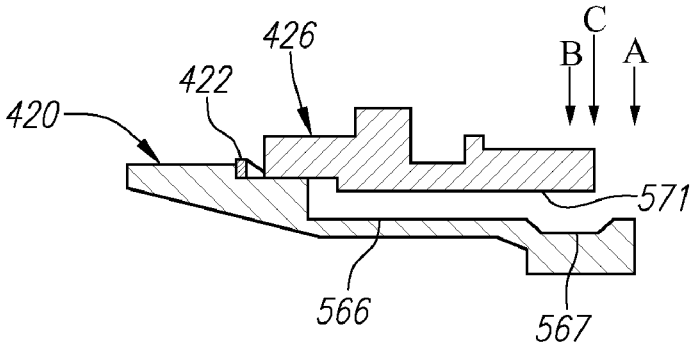
FIGS. 6G through 6I are different cross-sectional views illustrating a third relative position between the skirt lock ring and head.
Figure 6H:
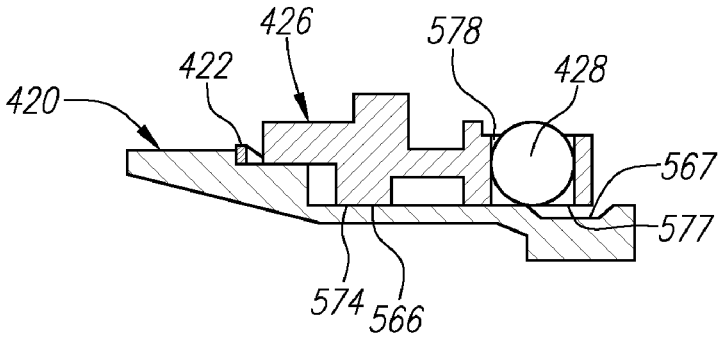
Figure 6I:
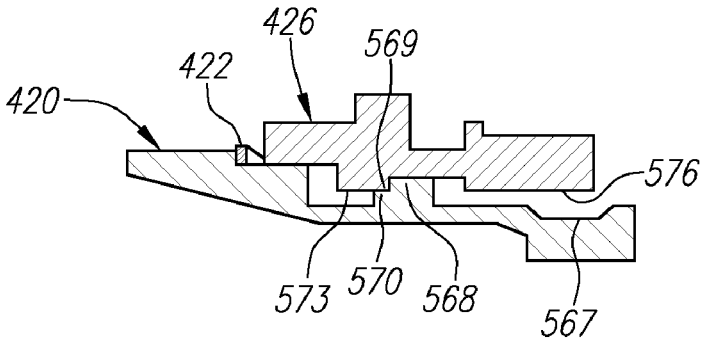

As best seen in FIGS. 6C, 6F, and 6I, a gap 531 is formed between each protuberance 568 and the front section 516 of head 420. In the present embodiment, six protuberances 568 are used. Each of the protuberances 568 has a relief cut 569 on the front end such that each of the protuberances 568 have a reversed L-shaped cross-section in the longitudinal direction of flashlight 400 as seen in FIG. 6C, for example. At the toe of the reversed L-shaped protuberances 568 is a lock member 570. In the present embodiment, the number of protuberances 568 is six. In other embodiments, the number of protuberances 568 may be different. However, the number of protuberances 568 should be an integer number greater than or equal to three.

As best seen in FIG. 5A, The inner surface of skirt lock ring 426 has a front end 581, an aft end 582 and a middle portion 583 in between. The inner surface of skirt lock ring 426 comprises a plurality of longitudinal channels 571 formed by a plurality of first indexing bumps 572 and second indexing bumps 575. In the present embodiment, six first indexing bumps 572 are formed near the middle portion 583 of the inner surface of the skirt lock ring 426 and six second indexing bumps 575 are formed near the aft end 582 of the inner surface of the skirt lock ring 426. Each of the first indexing bumps 572 comprises two high plateau regions 574 separated by a low plateau region 573. Similarly, each of the second indexing bumps 575 comprises two high plateau regions 577 separated by a low plateau region 576.

In the present embodiment, some of the high plateau regions 577 of the second indexing bumps 575 have a hole 578 sized to receive a ball 428. In the present embodiment, three holes 578 are equally spaced from each other around the inner circumference of skirt lock ring 426. In the present embodiment, the number of first indexing bumps 572 is the same as the number of second indexing bumps 575. In an alternate embodiment, the number of first indexing bumps 572 may be an integer multiple of the number of second indexing bumps 575. In another embodiment, the number of first indexing bumps 572 is an integer factor of the number of second indexing bumps 575. In the present embodiment, the number of second indexing bumps 575 is the same as the number of protuberances 568. In other embodiments, the number of second indexing bumps 575 may be an integer multiple of the number of protuberances 568.

FIGS. 6A-C show different cross-sectional views through the head 420 and skirt lock ring 426 when the skirt lock ring 426 has been rotated to a position which unlocks the head skirt 426 axially from the head 420. FIGS. 6A-6C also show skirt lock ring 426 in a position (position A) relative to head 420 where their aft ends are aligned. Balls 428 now sits in annular groove 567 and the top end 579 of ball 428 is lower than the top surface 580 near the aft end of skirt lock ring 426. Accordingly, head skirt 494 can be freely mounted to or dismounted from skirt lock ring 426 at this position. When every protuberance 568 of head 420 is aligned with a channel 571 of skirt lock ring 426 (as shown in FIG. 6C) by rotating skirt lock ring 426 to a suitable position, then the first indexing bumps 572 and the second indexing bumps 575 are aligned with the smooth surface 566 of skirt lock ring 426 (as shown in FIGS. 6A-6B). In this position, skirt lock ring 426 may be freely moved axially forward or rearward over head 420. FIG. 6A more particularly shows where low plateau regions 573, 576 of skirt lock ring 426 are aligned with the smooth surface 566 of head 420, and FIG. 6B more particularly shows where high plateau regions 574, 577 of skirt lock ring 426 are aligned with the smooth surface 566 of head 420. When the skirt lock ring 426 is indexed to this position, it is in a position in which it may be moved forward or rearward relative to head 420 by an operative amount. However, skirt lock ring 426 cannot be rotated relatively to head 420 because protuberances 568 and high plateau regions 574 are next to each other so that high plateau regions 574 extend too far out from skirt locking ring 426 to pass over protuberances 568.

When skirt lock ring 426 and head 420 are aligned as illustrated in FIGS. 6A-6C, skirt lock ring 426 may be pushed forward to position B against the spring force of wave spring 422, as shown in FIGS. 6D-6F. When skirt lock ring 426 is pushed forward in this manner protuberances 568 and high plateau regions 574 are no longer next to each other. As a result, skirt lock ring 426 can now be rotated relative to head 420 because high plateau regions will now pass through gap 531 between protuberance 568 and the front section 516 of head 420 as skirt lock ring 426 is rotated. Balls 428, however, no longer sit in annular groove 567, but instead are disposed on the smooth surface 566. As a result, the top end 579 of ball 428 is now higher than the top surface 580 near the aft end of skirt lock ring 426. If the head skirt 494 is mounted to the skirt lock ring 426, the ball 428 will extend into annular groove 429 formed in the interior surface of head skirt 494. However, because protuberances 568 remain aligned with channels 571, the skirt lock ring 426 remains subject to being moved rearward to position A shown in FIGS. 6A-6C and thus the head skirt 494 is not axially locked to the head 420 at this point.

When skirt lock ring 426 and head 420 are aligned as described in FIGS. 6D-6F, skirt lock ring 426 can be rotated relatively to head 420. If a user rotates skirt lock ring 426 30° in either direction and then releases the skirt lock ring 426 wave spring 422 will bias the skirt lock ring 426 rearward, and the relationship between skirt lock ring 426 and head 420 will be the position (position C) as shown in FIGS. 6G-6I. Now, protuberances 568 are aligned with low plateau regions 573 (as shown in FIG. 6I). Further, the spring force of wave spring 422 pushes skirt lock ring 426 rearward until a corner of each low plateau region 573 fits into a space formed by relief cut 569 of an opposing protuberance 568 and lock members 570 are positioned under the low plateau regions 573. In this manner, skirt lock ring 426 cannot be rotated relatively to head 420 because each side of lock member 570 of protuberances 568 is now next to a high plateau region 574. In addition, balls 428 are still disposed on the smooth surface 566, and, as a result, the top end 579 of ball 428 is still higher than the top surface 580 near the aft end of skirt lock ring 426. Thus, if head skirt 494 is mounted, it will be axially locked by ball 428 to head 420 and cannot be dismounted (as shown in FIGS. 2-3).

When head skirt 494 is locked (as shown in FIGS. 2-3), the skirt lock ring 426 and head 420 are aligned as illustrated in FIGS. 6G-6I. To access adjusting ring 448 to adjust the alignment of the beam direction of the substantial point source of light, namely LED 445 of LED module 444 in the present embodiment, with the principal axis of the reflector, head skirt 494 must be unlocked and slid rearward over front barrel 508 at least far enough for the user to gain access to adjustment ring 448. The procedure for accomplishing this is described below.

First, when head skirt 494 is axially locked to the head 420 by the skirt locking ring 426, the skirt lock ring 426 and head 420 are aligned as illustrated in FIGS. 6G-6I. Further, skirt lock ring 426 cannot be rotated relative to head 420. However, the head skirt 494 is free to rotate about the skirt locking ring 426 and front barrel 508 to axially translate the light source along the axis of the reflector as discussed more fully below. Further, the skirt lock ring 426 together with the head skirt 494 may be pushed forward against wave spring 422 to unlock skirt lock ring 426 from head 420. By rotating the skirt lock ring 426 30° in either direction, the skirt lock ring 426 and head 420 are aligned as illustrated in FIGS. 6D-6F, and, as a result, the head skirt 494 is axially unlocked from the head member 494 and thus may be removed from the flashlight 400. This is because skirt lock ring 426 is now free to move from position B to position A, and once skirt lock ring 426 and head 420 are aligned in position A, as shown in FIGS. 6A-6C, balls 428 will fall into trench 567 and the top end 579 of balls 428 will no longer be higher than the top surface 580 near the aft end of skirt lock ring 426. Accordingly, head skirt 494 may continue to be moved rearward and dismounted and no longer locked by ball 428 and head skirt 494 can now be dismounted. However, cam 488 will block skirt lock ring 426 from moving rearward beyond its position in position A.

If it is desired to mount head skirt 494 back to have a complete flashlight assembly, the following procedure can be used. First, head skirt 494 is slid forward over the flashlight front barrel 508 until it abuts skirt lock ring 426. Once head skirt 494 abuts skirt lock ring 426, head skirt 494 together with skirt lock ring 426 may be pushed forward to position B against the spring force of wave spring 422, as shown in FIGS. 6D-6F. Balls 428 are now disposed on the smooth surface 566 and the top end 579 of ball 428 is higher than the top surface 580 near the aft end of skirt lock ring 426 so as to extend into annular groove 429 in head skirt 494.

Once in position B, skirt lock ring 426 may be rotated 30° in either direction and then released. Wave spring 422 will bias the skirt lock ring 426 rearward so that the skirt lock ring 426 and head 420 are placed in position C as shown in FIGS. 6G-6I. At this point, skirt lock ring 426 can no longer be rotated because lock members 570 of protuberances 568 are now locked by high plateau regions 574. Because balls 428 are now disposed on the smooth surface 566, as shown in FIG. 6H and skirt lock ring 426 cannot be rotated, head skirt 494 is axially locked to the head 420 and cannot be dismounted (as shown in FIGS. 2-3).

Referring back to FIGS. 3-4, one-way valves 424 and 430, such as a lip seal, are preferably provided at the interface between face cap 412 and skirt lock ring 426 and also at the interface between head skirt 494 and skirt lock ring 426 to provide a watertight seal and to prevent moisture and dirt from entering head and switch assembly 406.

As noted above, a portion of front barrel 508 is disposed under head skirt 494 when it is mounted to the flashlight 400. The forward most portion of the front barrel 508 is interposed between, and threadably attached to, the aft section 530 of the head 420 and retainer 432 as explained above. As a result of the foregoing construction, with the exception of the external surface formed by switch cover 500, all of the external surfaces of the flashlight 400 according to the present embodiment may be made out of metal, and more preferably aluminum.

Front barrel 508 is provided with a hole 544 through which a seal or switch cover 515 of switch 500 extends. The outer surface of front barrel 508 surrounding switch cover 515 may be beveled to facilitate tactile operation of flashlight 400. Front barrel 508 may also be provided with a groove 546 about its circumference at a location forward of the trailing edge 548 of head skirt 494 for positioning a sealing element 496, such as an O-ring, to form a watertight seal between the head skirt 494 and front barrel 508. Similarly, switch cover 515 is preferably made from molded rubber. As best illustrated in FIG. 3, switch cover 515 is preferably configured to prevent moisture and dirt from entering the head and switch assembly 406 through hole 544.

Figure 5B:
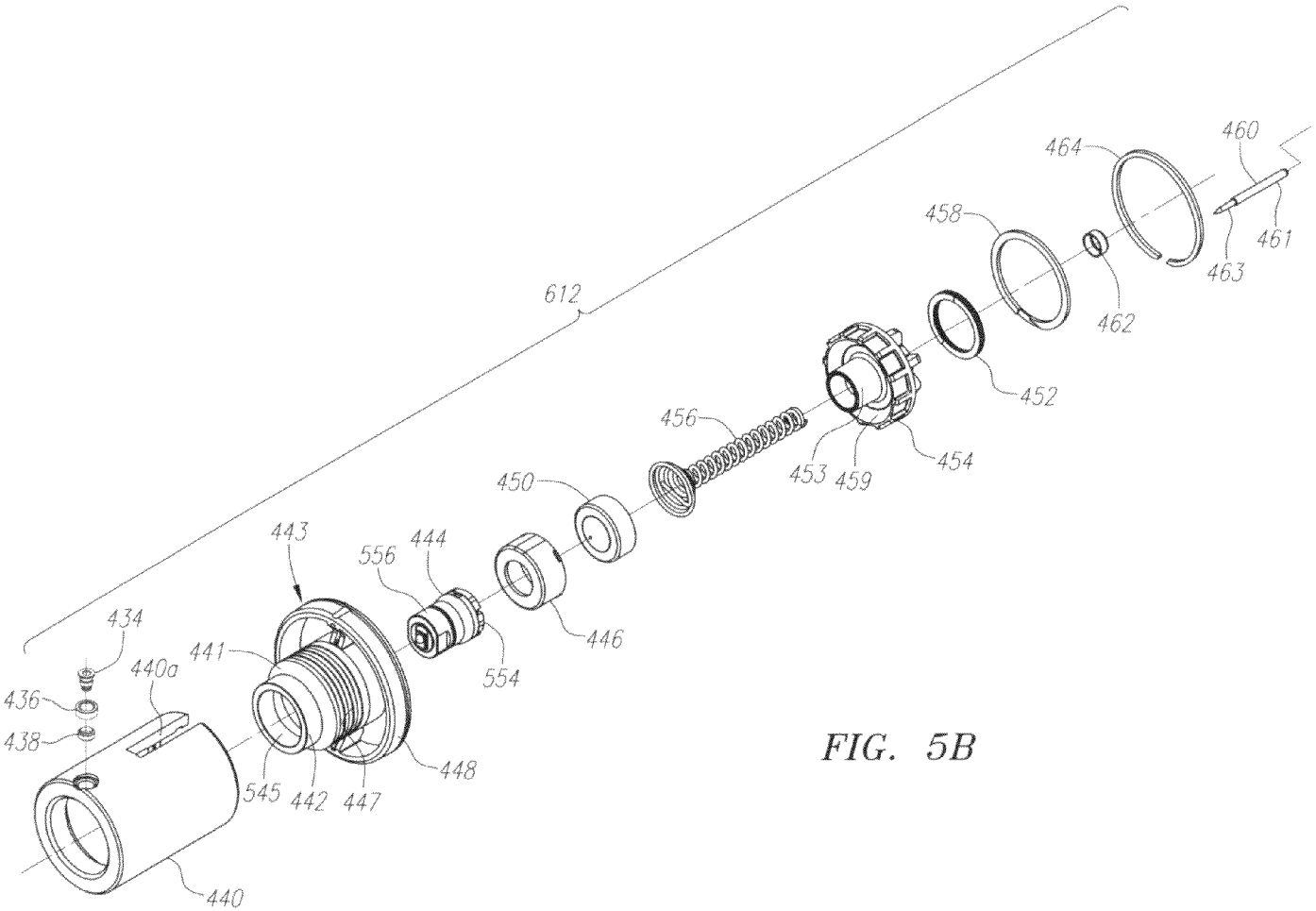
FIG. 5B is an enlarged exploded perspective view of the adjustable ball assembly portion of the flashlight of FIG. 1.

Referring to FIG. 5B, the components of an adjustable ball assembly 612 according to the present embodiment are illustrated. In one embodiment, the adjustable ball assembly 612 may include a metal tubular ball housing 440, a ball assembly 443 having a ball 442 and adjusting ring 448, a lighting module 444, a funnel spring 456 and a ball retainer 454. The tubular ball housing 44 may have a forward end, a rearward end and a slot 440*a* on the rearward end. The adjusting ring 448 may partially be inserted into the slot 440*a*. In the present embodiment, a lamp or other light source, such as LED 445 of LED module 444, is mounted within head and switch assembly 406 so as to extend into reflector 418 through a central hole provided therein. In particular, LED module 444 is mounted on adjustable ball assembly 612, which in turn is slideably mounted within front barrel 508. The adjustable ball assembly 612 is prevented from sliding out of front barrel 508 by retainer 432, head 420, and cam assembly 488, 490 and cam follower assembly 435. In the present embodiment, cam follower assembly 435 includes a cam follower screw 434, a cam follower roller 436, and a cam follower bushing 438.

An LED module that may be used for LED module 444 is described in co-pending U.S. patent application Ser. No. 12/188,201, filed Aug. 7, 2008, by Anthony Maglica et al., the contents of which is hereby incorporated by reference.

Referring to FIGS. 3 and 5B, when adjustable ball assembly 612 is positioned inside front barrel 508 and the cam follower assembly 435 is positioned in one of the axial slots 411 the radial arms of adjusting ring 448 will extend through the opposing slots of front barrel 508. Further, the reflector 418 is sized so that the LED module 444 held by the adjustable ball assembly 612 is positioned adjacent the central opening in the aft end of reflector 418.

Still referring to FIG. 3, the moveable cam assembly 488, 490 is sized to fit around the outer diameter of the front barrel 508. Front cam half 488 and rear cam half 490 form the cam assembly 488, 490 which is generally a barrel cam with a curved cam channel 550 that extends around the inner circumference of the cam assembly 488, 490. The cam assembly 488, 490 is also sized such that when installed, the cam follower roller 436 of the cam follower assembly 435 engages with cam channel 550. Accordingly, the cam channel 550 is able to define the axial rise, fall, and dwell of the adjustable ball assembly 612. This is because the cam follower assembly 435 is able to slide in the curved cam channel 550 of the cam assembly 488, 490 when cam assembly 488, 490 is rotated.

The cam assembly is held longitudinally in place between the aft end of head 420 and snap ring 492. Because the curved cam channel 550 is disposed transverse to the axis of the flashlight 400, when cam assembly 488, 490 is rotated, ball housing 440 (along with LED module 444) will move forwards and backwards along the longitudinal direction of flashlight 400, changing the dispersion of light created by the flashlight from spot to flood and then from flood to spot.

In the present embodiment, front barrel 508 preferably includes a groove 552 about its circumference for positioning external snap ring 492 to keep the cam assembly 488, 490 from moving toward the rear direction of the flashlight 400.

Cam assembly 488, 490 is preferably a two piece construction so that the separate halves may be fitted over the outer diameter of the flashlight front barrel 508 and the cam follower assembly 435. The tow pieces of the moveable cam assembly 488, 490 may be secured together by any suitable method. Preferably, the respective cam halves are formed to snap together.

Figure 4:
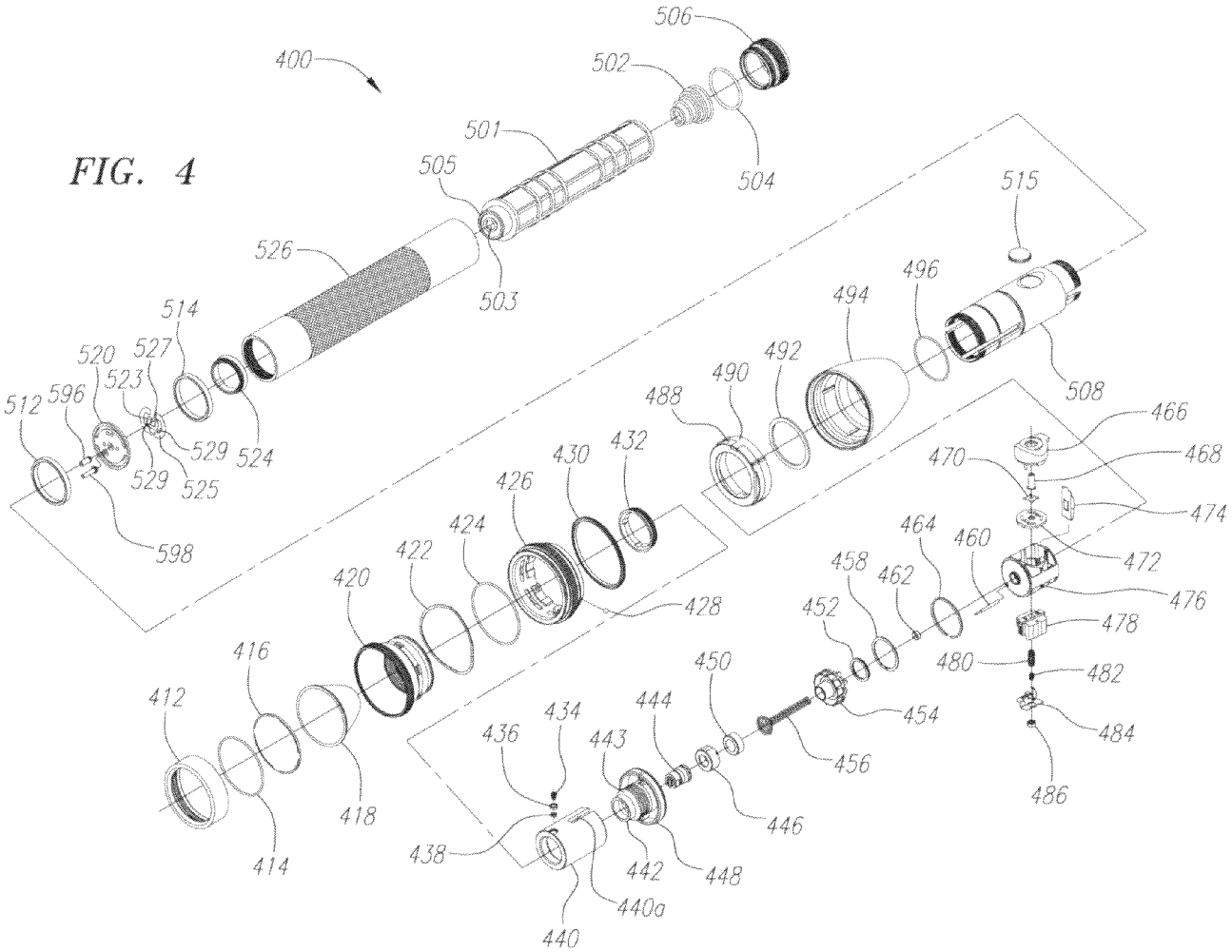
FIG. 4 is an exploded perspective view of the flashlight of FIG. 1.

Referring to FIGS. 3 and 4, longitudinal locking ribs are provided on the outer diameter of the cam assembly 488, 490. Preferably the locking ribs are equally spaced around the outer circumference of the cam assembly. Corresponding longitudinal locking slots are provided on the interior surface of the head skirt 494. As a result, when head skirt 494 is mounted on the flashlight 400 and it is rotated about the axis of the front barrel 508, cam assembly 488, 490 will also be caused to rotate about the front barrel 508. Rotation of the cam assembly 488, 490 in turn will cause the adjustable ball assembly 612 to axially displace along the inside of reflector 418. In this way, the LED module 444 or other light source may be caused to translate along the reflector axis.

One of the electrode contacts, the negative electrode 556, in the present embodiment, of LED module 444 is configured to make electrical connection with the surface of through hole 545 of ball 442, which is preferably made out of metal. As previously described, the ball 442 is slideably mounted via ball housing 440, which is also preferably made out of metal, within front barrel 508.

Another electrode contact, the positive electrode 554, in the present embodiment, of LED module 444 is in electrical communication with funnel spring 456 via contact cup 450.

The surface of through hole 545 of ball 442, in the present embodiment, is shaped to operatively receive and hold LED module 444 so that the negative electrode 556 of LED module 444 is in contact with as much surface area of ball 442 as possible, thereby not only forming an electrical path between the negative contact 556 of LED module 444 and ball 442 but also providing an efficient thermal dissipation path between the LED module 444 and ball 442.

In the present embodiment, the outer surface of ball 442 comprises a plurality of cooling fins 447 which increase the surface area of the ball 442 and its heat dissipation rate. In other embodiments, cooling fins 447 may be omitted or other forms of cooling fins may be employed.

In the present embodiment, a plastic adjusting ring 448 is molded around metal ball 442 to form a unitary ball assembly 443. Adjusting ring 448 may be used to slightly adjust the axial direction of LED module 444, and hence LED 445 within adjustable ball assembly 612. Although, in other embodiments, the adjusting ring 448 and ball 442 may be separate components, providing adjusting ring 448 and ball 442 as a co-molded ball assembly 443, as in the present embodiment, simplifies manufacturing.

LED module 444 is pressed forward within through hole 545 of ball 444 until a flared portion of LED module 444 comes into contact with a corresponding shaped region of reduced diameter within through hole 545. Front contact cup 450 is in electrical communication with the front end of a funnel-shaped spring 456, which is preferably made out of a spring metal, such as phosphor bronze. The rear end of the funnel shaped spring 456 is held by a rear contact cup 462, which is preferably made out of metal. In the present embodiment, front contact cup 450 includes a pointed region, which is configured to extend into the back of LED module 444 to contact positive electrode 554, which is recessed from the back of LED module 444.

Insulator 446, which includes a through hole on its forward end, is provided to prevent the front contact cup 450 from coming in electrical contact with the ball 442. During assembly, insulator 446 would be inserted into through hole 545 after LED module 444. The front contact cup 450 would then be inserted so that the pointed portion of contact cup 450 extends through the central through hole formed in insulator 446. Insulator 446 is preferably made out of non-conductive material, such as plastic.

The widest portion of funnel-shaped spring 456 is received within front contact cup 450 so as to make physical and electrical contact therewith, and so that the narrower portion of funnel-shaped spring 456 extends rearward beyond the aft end of ball housing 440.

A ball retainer 454 having a through hole 455 shaped to accommodate funnel-shaped spring 456 is used to push ball assembly 443 forward within the through hole 545. Ball retainer 454 includes, on a forward facing surface 457 thereof, a ball engagement surface 459 configured to operatively mate with the aft end of ball 442 so that ball 442 may be adjusted slightly within ball housing 440.

In general, the forward curved surface 441 of ball 442 and the rearward curved surface 449 of ball 442 are preferably have a spherical profile to facilitate the adjustment of ball 442 within ball housing 440. Likewise, the ball engagement surface 451 of ball housing 440 and the ball engagement surface 459 of ball retainer 454 preferably have mating angled surfaces.

Ball retainer 454 also includes a cylindrical projecting portion 453, which is sized to fit within forward contact cup 450. Based on this configuration, the widest portion of funnel-shaped spring 456 is mechanically interposed between forward contact cup 450 and the forward end of the cylindrical projecting portion 453 of ball retainer 454.

In the present embodiment, the inner surface at the rear portion of ball housing 440 has a groove to support a snap ring 458. A wave spring 452 is further interposed between the snap ring 458 and ball retainer 454. Wave spring 452 biases ball retainer 454 forward so that ball engagement surface 459 engages with the aft end of ball 442, which in turn biases ball 442 forward until the forward end of ball 442 engages with the ball engagement surface 451 of ball housing 440. Further, in addition to biasing ball retainer 454 into the aft end of ball 442, wave spring 453 biases ball retainer 454 so that the cylindrical projecting portion compresses the forward end of funnel-shaped spring 456 against contact cup 450, which in turn biases LED module 444 forward within through hole 545 of ball 442 until the flared portion of LED module 444 comes in contact with the wall of through hole 545. As a result, negative electrode 556 of LED module 444 is in intimate physical and electrical contact with ball 442.

The forgoing construction provides a simplified adjustable ball assembly 612, which may be pre-assembled before inclusion in flashlight 400 or another flashlight or portable lighting device. It also allows the use of a single funnel-shaped spring 456 between the front contact cup 450 and the rear contact cup 462, without the need of using contact sleeves to retain a biasing member such as a coil spring, therefore simplifying the manufacturing process and reducing manufacturing costs.

Rear contact cup 462 is frictionally held by main switch housing 476 so that the aft end of rear contact cup 462 is in electrical communication with L-shaped contact 562 on lower switch housing 478. Further, once adjustable ball assembly 612 is included in flashlight 400, funnel-shaped spring 456 is compressed between front contact cup 450 and rear contact cup 462, thereby forcing rear contact cup 462 into intimate physical and electrical contact with L-shaped contact 562 on lower switch housing 478. As a result, funnel-shaped spring 456 is able to maintain electrical contact between front and rear contact cups 450, 462 as ball housing is axially moved forward and backwards within barrel 508 due to the operation of cam assembly 488, 490.

In the present embodiment, a compressible spring probe 460, which is preferably made out of metal, is provided to establish a ground path between ball housing 440 and ground contact 486. The spring probe 460 includes a barrel 461, a plunger 463 and a spring (not shown) therebetween within the barrel 461 for biasing the plunger 463 away from barrel 461. Spring probe 460 is sized so that as ball housing 440 axially slides forward and backwards within front barrel 508 due to the operation of assembly 488, 490, spring probe 460 remains compressed between ball housing 440 and ground contact 484, thereby maintaining electrical contact between the ball housing 440 and ground contact 484 at all times.

Figure 5C:
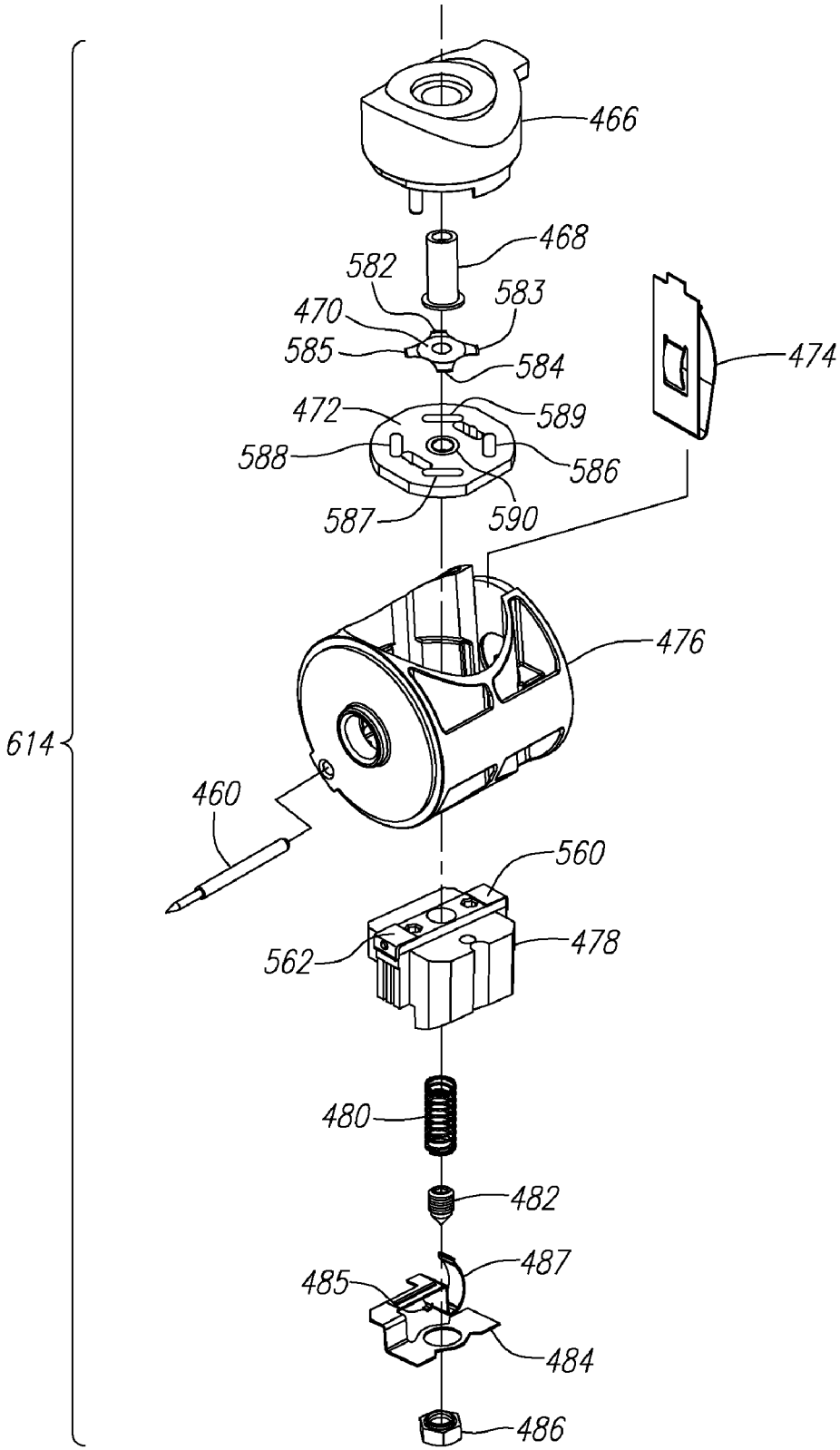
FIG. 5C is an enlarged exploded perspective view of the switch assembly portion of the flashlight of FIG. 1.
Figure 5D:
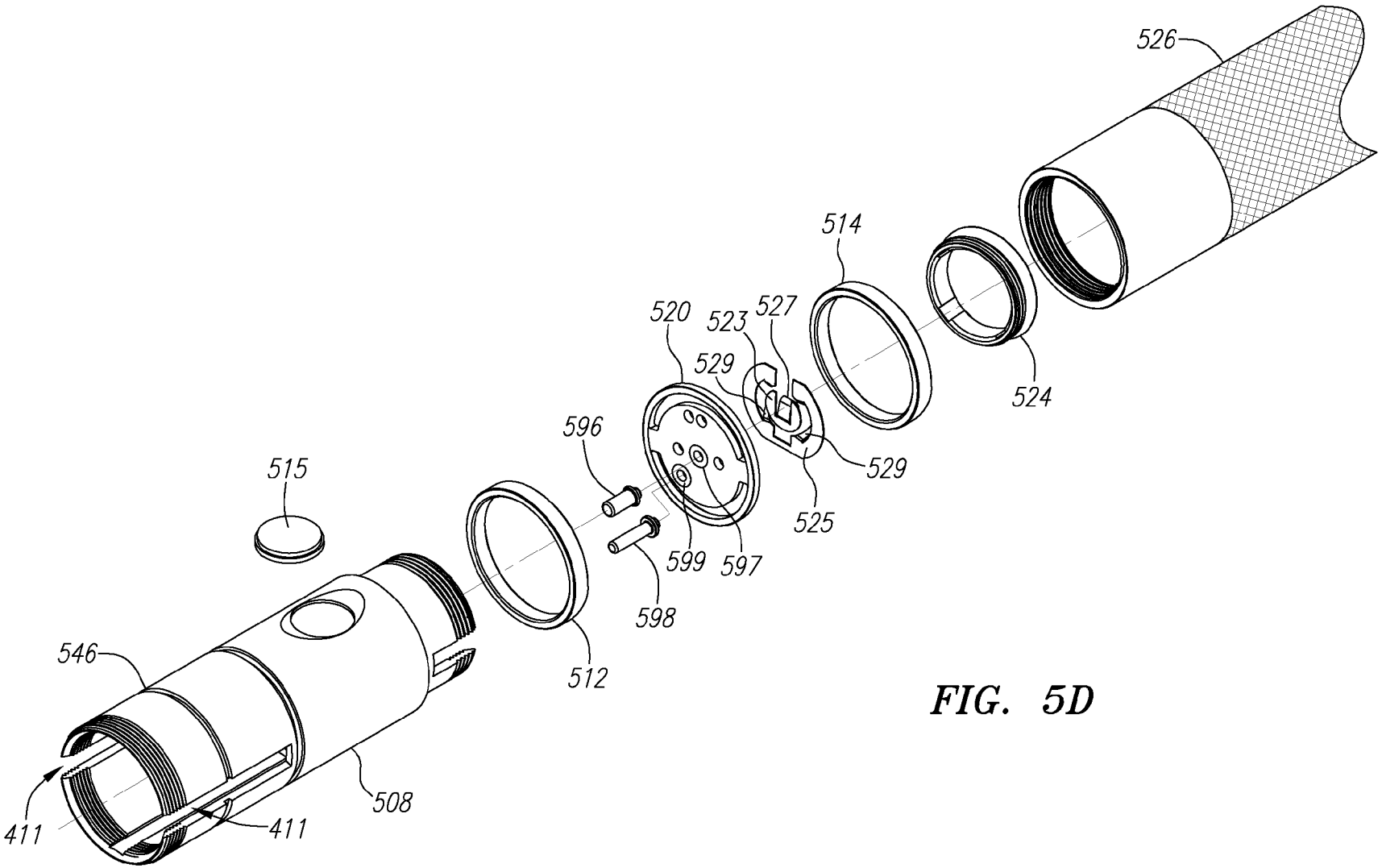
FIG. 5D is an enlarged exploded perspective view from the forward end of the flashlight of FIG. 1 illustrating how the front barrel and rear barrel of the flashlight are assembled together with the circuit board and charge rings.
Figure 5E:
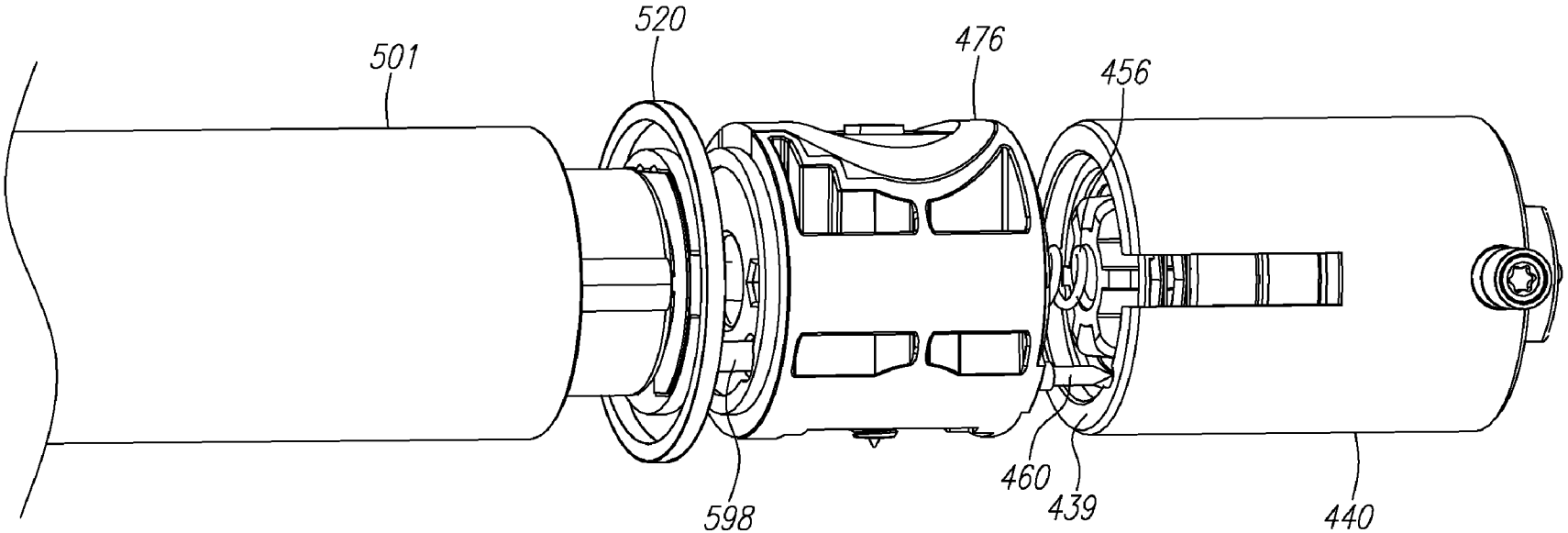
FIG. 5E is an enlarged perspective view of the ball housing, switch housing and battery pack (with the front and rear barrels been removed) of the flashlight of FIG. 1 for illustrating the ground path of the flashlight of FIG. 1.

Referring to FIGS. 3, 4, 5B, 5C, and 5E, the barrel 461 end of spring probe 460 is inserted through a hole provided in the switch housing 476 to make electrical contact with the downward extending leg 485 of ground contact 484. As best seen in FIG. 5E, the plunger 463 of spring probe 460 contacts the rear wall 439 of ball housing 440. Therefore, an electrical communication between the ground contact 484 within the switch housing 476 and the ball housing 440 is established and maintained throughout operation of flashlight 400 by spring plunger 460.

Referring to FIGS. 3, 4 and 5C, the components of switch assembly 614 will now be described. Switch assembly 614 preferably includes a main switch housing 476 and a user interface, which is a switch cover 500 in the present embodiment. Main switch housing 476 encloses an upper switch housing 466, an actuator 468, a snap dome 470, an assembled circuit board 472, a snap in contact 474, a lower switch housing 478, a switch spring 480, a set screw 482, a ground contact 484, and a hex nut 486. In the present embodiment, snap in contact 474, switch spring 480, set screw 482, ground contact 484, and hex nut 486 are preferably made out of metal while main switch housing 476, upper switch housing 466, actuator 468, and lower switch housing 478 are preferably made out of non-conductive material, such as plastic.

Referring to FIG. 5C, in the present embodiment, the snap dome 470 has four legs with one leg 582 shorter than other three legs 583, 584, 585. The legs 583, 584, 585 are used to contact to ground pads 586, 587, 588 on assembled circuit board 472 while the short leg 582 is used to contact with a momentary pad 589 on assembled circuit board 472. A ring-shaped latch pad 590 is placed in the middle of the assembled circuit board 472. In the present embodiment, the momentary pad 589 is closer to the center of assembled circuit board 472 than other three pads.

When switch 500 is not depressed, short leg 582 is not in contact with any portions on assembled circuit board 472. In this situation, both latch pad 590 and momentary pad 589 on assembled circuit board 472 are not in contact with ground pads 586, 587, 588 on assembled circuit board 472.

When switch 500 is depressed half way down, actuator 468 pushes snap dome 470 toward assembled circuit board 472. In this situation, short leg 582 makes contact with momentary pad 589 even though the central body of snap dome 470 remains out of contact with latch pad 590 of assembled circuit board 472. Because the whole snap dome 470 is made of metal, the momentary pad 589 is now connected to ground, while the latch pad 590 is not.

When switch cover 515 is further depressed, actuator 468 pushes snap dome 470 further down until snap dome 470 collapse such that the body of snap dome 470 is in contact with latch pad 590. Now, not only momentary pad 589 is connecting to ground, latch pad 590 is also connecting to ground.

When momentary pad 589 or latch pad 590 are connected to ground are received as signals to the assembled circuit board 472, which in turn passes or disrupts the energy flow from the batteries in the hollow space 499 to the aft end of rear contact cup 462. In this way, head and switch assembly 406 can turn the flashlight 400 on or off. The assembled circuit board 472 may additionally include circuitry suitable for providing functions to the flashlight 400 which will be described in more detail later.

Snap in contact 474 is configured to include curved springs or biasing elements to ensure electrical contact is maintained with positive contact pin 596 and L-shaped contact 560.

Lower switch housing 478 includes two L-shaped contacts 560, 562. L-shaped contact 560 is used to form electrical connection with a positive contact of the assembled circuit board 472 while also electrically contacting one of the biasing elements of snap in contact 474. L-shaped contact 562 is used to electrically contact with another positive contact of the assembled circuit board 472 while also electrically contacting with the aft end of rear contact cup 462.

Ground contact 484 is secured by hex nut 486 so that it is in electrical communication with set screw 482, which in turn is electrically coupled to switch spring 480, which in turn is electrically coupled to a ground contact of the assembled circuit board 472.

Ground contact 484 includes a downwardly extending leg portion 485 (shown in FIG. 5C) for establishing electrical contact with the aft end of the spring probe 460. Ground contact 484 also has an upwardly bent leaf spring portion 487 (shown in FIG. 5C) for contacting ground contact pin 598. A wall of main switch housing 476 is disposed between downwardly extending leg portion 485 and upwardly bent leaf spring 487 so that both are provided with structural support in the axial direction.

FIG. 5D is an enlarged exploded perspective view from the forward end of the flashlight of FIG. 1 illustrating how the front barrel 508 and rear barrel 526 of the flashlight 400 are assembled together with the circuit board 520 and charge rings 512 and 514.

Cathode contact 523 and anode contact 525 are preferably mounted to charger circuit board 520 using solder. Cathode contact 523 has a spring element 527 formed therein. Anode contact 525 has spring elements 529 formed therein. When battery pack 501 is installed in the hollow space 499 of barrel 526, the spring element 527 of the cathode contact 523 are in contact with the cathode 503 of battery pack 501 while the spring elements 529 of anode contact 525 are in electrical contact with the anode 505 of battery pack 501.

Referring to FIGS. 3, 4 and 5D, the positive contact pin 596 is preferably swaged and soldered to a central via 597 extending through the charger circuit board 520. The rearward end of positive contact pin 596 is in electrical contact with the cathode contact 523. The ground contact pin 598 is preferably swaged and soldered to an outer via 599 extending through the charger circuit board 520. The rearward end of ground contact pin 598 is in electrical contact with the anode contact 525.

As best seen in FIG. 5E, ground contact pin 598 extends through a hole formed in the aft end of the main switching housing 476 to contact the upwardly bent leaf spring 487 of ground contact 484 and thereby form an electrical path between ground contact 484 and anode contact 525. As seen in FIG. 3, positive contact pin 596 also extends through a hole formed in the back of main switch housing 476 to control snap in contact 474 and compress the same, thereby forming an electrical path between the snap in contact 474 and cathode contact 523.

When battery pack 501 is installed into the hollow space 499, in the present embodiment, a circuit path for supporting the charger circuit board 520 and for recharging the battery pack 501 is formed from the cathode 503 of battery pack 501 to the cathode contact 523, a positive contact pad (not shown) on charger circuit board 520, to the charger circuit board 520. The ground path can be formed from the ground pad (not shown) on the charger circuit board 520, to the anode contact 525, and then to the anode 505 of battery pack 501.

Electrical current for powering the assembled circuit board 472 flows from the cathode 503 of battery pack 501 to the cathode contact 523, positive contact pin 596, snap in contact 474, L-shaped contact 560, and to the positive power pad (not shown) on the assembled circuit board 472. The ground path for return current flow from the electronics of the assembled circuit board 472 to battery pack 501 extends from the ground pad (not shown) on the assembled circuit board 472 to switch spring 480, set screw 482, ground contact 484, ground contact pin 598, anode contact 525, and finally, the anode 505 of battery pack 501.

Electrical current for powering the load (LED module 444) flows from the cathode 503 of battery pack 501 to the cathode contact 523, positive contact pin 596, snap in contact 474, L-shaped contact 560, a first positive power pad (not shown) on the assembled circuit board 472, a second positive power pad (not shown) on the assembled circuit board 472, L-shaped contact 562, aft contact cup 462, funnel-shaped spring 456, front contact cup 450, to the positive electrode 554 of LED module 444. The ground path of the load includes the negative electrode 556 of LED module 444, ball 442, ball housing 440, spring probe 460, ground contact 484, ground contact pin 598, anode contact 525, and anode 505 of battery pack 501.

In other words, in the present embodiment, neither the front barrel 508 nor the rear barrel 526 is used as a part of the electric path for charging the battery pack 501, powering the assembled circuit board 472, or powering the LED module 444. Likewise, in the present embodiment, tail cap 506 is not used as a part of the electrical path for charging the battery pack 501, powering the assembled circuit board 472, or powering the LED module 444. The configuration of the embodiment described above in connection with FIGS. 1-5E provides several advantages. First, it simplifies the manufacturing process and manufacturing cost by eliminating the head, barrel, and tail cap from the electrical circuits of the flashlight. Further, the adjustable ball housing is simplified.

Figure 7:
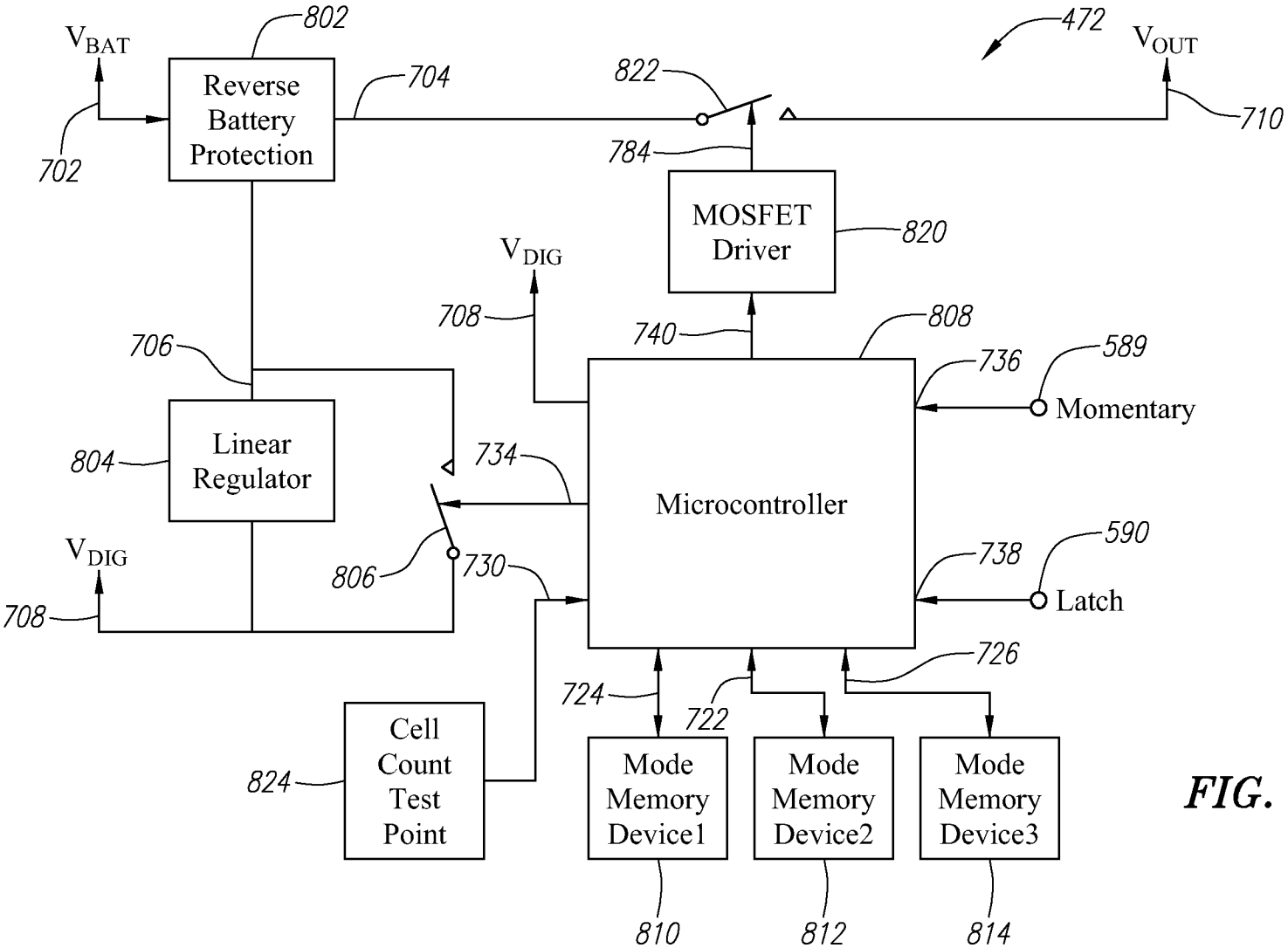
FIG. 7 is a circuit diagram illustrating the relationship of the electronic circuitry according to one embodiment of the invention.

Assembled circuit board 472 will now be described in connection with FIGS. 7 and 8A-8E. For the purpose of simplification, assembled circuit board 472 is described in connection with flashlight 400. However, it is to be understood that assembled circuit board 472 as well as switch assembly can also be used in other flashlights or portable lighting devices. FIG. 7 is a block diagram illustrating the relationship of the electronic circuitry of assembled circuit board 472. In the embodiment of FIG. 7, assembled circuit board 472 includes a microcontroller circuit 808, a reverse battery protection circuit 802, a linear regulator circuit 804, a first mode memory device 810, a second mode memory device 812, a third mode memory device 814, a bypass switch 806, a MOSFET driver 820, an electric load switch 822, a momentary pad 589, a latch pad 590, and a cell count test point 824. Detailed electrical circuit schematics of assembled circuit board 472 are shown in FIGS. 8A-8E.

Figure 8A:
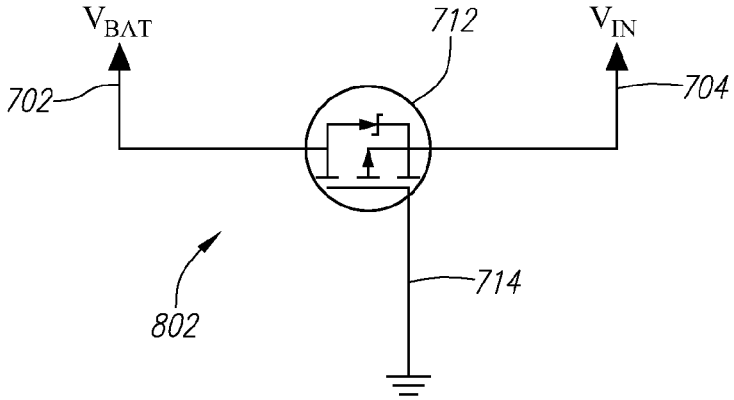
FIGS. 8A-E are schematic circuit diagrams of different components of the circuit shown in FIG. 7.

FIG. 8A shows a preferred circuit schematic diagram of reverse battery protection circuit 802. In the present embodiment, the reverse battery protection circuit 802 takes the voltage 702 from the cathode of a battery of a battery pack 501 and electrically connects it to an electronic load switch, such as a p-channel metal-oxide-semiconductor field-effect transistor (PMOS) 712. The gate of PMOS 712 is connected to ground 714 while the drain of PMOS 712 is connected to an internal voltage supply 704 for assembled circuit board 472. With this reverse battery protection circuit 802, when the battery or battery pack is installed in reverse order, no current will flow through current paths of the flashlight.

Figure 8B:
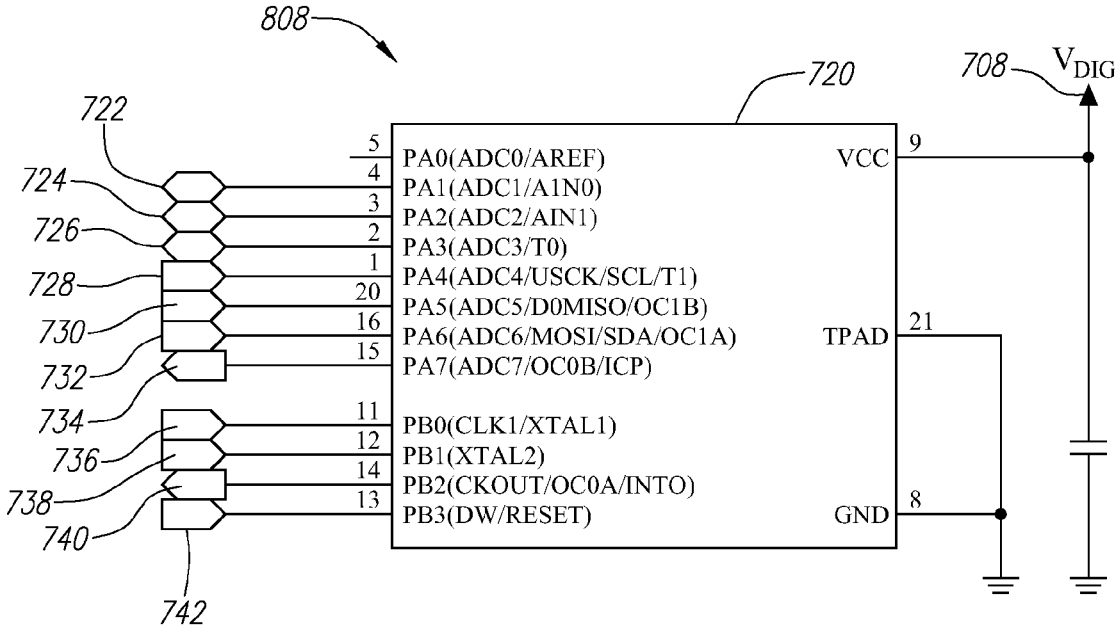

Referring to FIG. 8B, microcontroller circuit 808 includes a microcontroller 720 and connections. Microcontroller 720 receives input signals through signal lines ADC_MODE_CAP1 722, ADC_MODE_CAP2 724, ADC_MODE_CAP3 726, MISO 730, MOMENTARY_SWITCH 736, MAIN_SWITCH 738, and RESET 742. Microcontroller 720 also delivers output signals through signal lines ADC_MODE_CAP1 722, ADC_MODE_CAP2 724, ADC_MODE_CAP3 726, BYPASS_LDO 734, and LAMP_DRIVE 740. Accordingly, signal lines ADC_MODE_CAP2 722, ADC_MODE_CAP1 724, ADC_MODE_CAP3 726 are bi-directional. In one embodiment, the microcontroller 720 is a commercial microcontroller having embedded memory, such as, for example, ATtiny24 which is an 8-bit microcontroller manufactured by Atmel Corporation of San Jose, Calif. In another embodiment, the microcontroller 720 can be a microprocessor. Yet in other embodiments, the microcontroller 720 can be discrete circuits.

Microcontroller 720 has a power supply source 708 to provide a voltage input. Typically, microcontroller 720 cannot accept a power supply having a voltage higher than a predefined value, for example, 5.5 volts. However, assembled circuit board 472 is configured to be useable in a flashlight containing two, three or four dry cell batteries or cells electrically connected in series (depending on the length of rear barrel). Thus, battery voltage source 702 (and also 704) range from 3.0 volts to 6.0 volts. If a flashlight is designed to be used with four batteries connected in series, depending on the particular implementation, voltage from the battery voltage source 702 cannot be used to supply the microcontroller 708 directly.

Figure 8C:
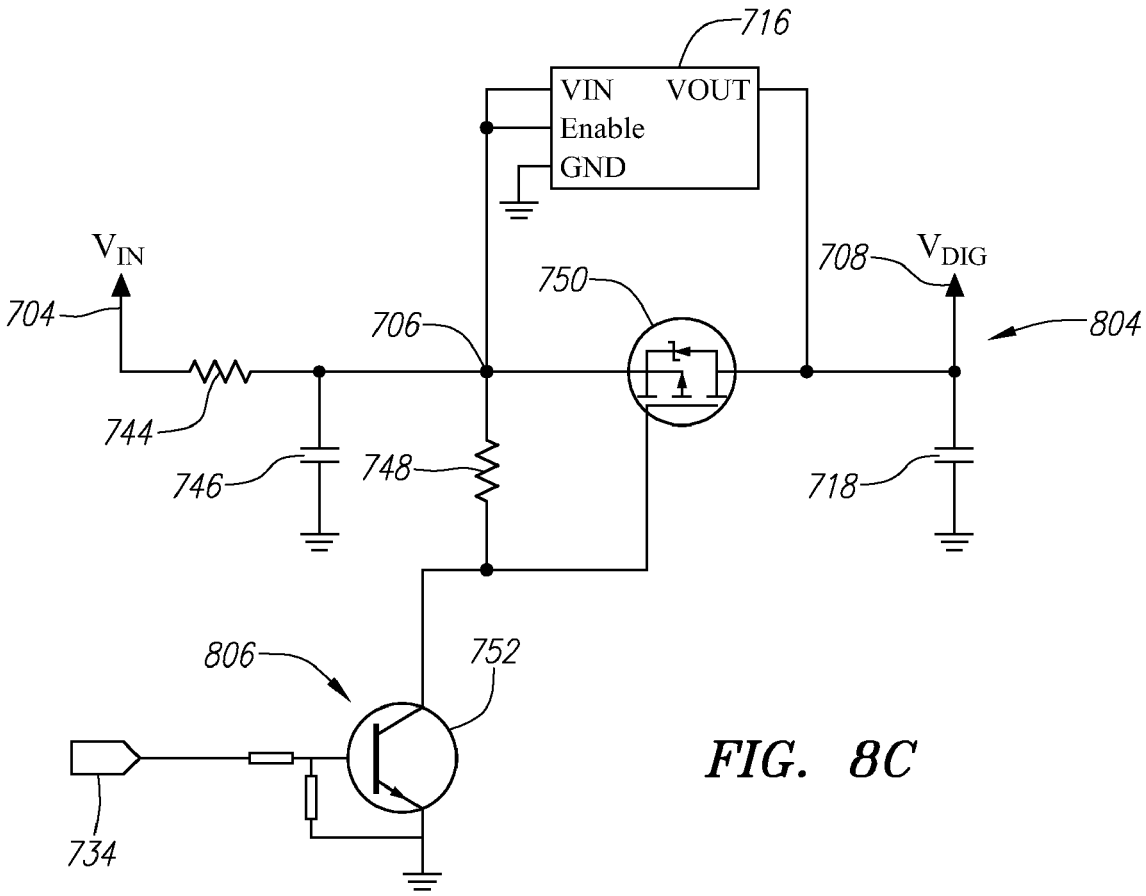

FIG. 8C shows a circuit schematic diagram of one embodiment of a linear regulator circuit 804. The illustrated linear regulator circuit 804 takes the internal voltage supply 704 from reverse battery protection circuit 802 as an input voltage and converts it into digital voltage output source 708 for supplying the microcontroller 708 through two different paths. The first path is through a low drop-out (LDO) linear voltage regulator 716 and the second path is to bypass the LDO linear voltage regulator 716 and pass through a PMOS 750.

When a flashlight is designed for receiving four or more batteries or cells electrically connected in series, internal voltage supply 704 cannot be used to supply microcontroller 720 directly. Accordingly, signal line BYPASS_LDO 734 would be turned low by microcontroller 708. Thus, bipolar transistor 806 with built-in resistors will not conduct. As a result, PMOS 750 also will not conduct, therefore, resulting in internal voltage supply 704 being converted to digital voltage output source 708 through LDO linear voltage regulator 716, which will provide an output voltage that is lower than the input voltage supply. In an embodiment in which four batteries or cells are connected electrically in series, the LDO linear voltage regulator 716 is preferably configured to drop the input voltage by about 1.0 volt.

If flashlight 400 is designed for receiving two or three batteries in series, or if flashlight 400 is powered by battery pack 501, internal voltage supply 704 may be used to supply microcontroller 720 directly. In these situations, signal line BYPASS_LDO 734 would be turned high by microcontroller 708. In this situation, bipolar transistor 806 with built-in resistors would be closed so as to conduct, and, therefore, PMOS 750 would also be closed and thereby conduct. Internal voltage supply 704 would, therefore, be converted to digital voltage output source 708 through PMOS 750, and bypass the LDO linear voltage regulator 716.

In the embodiment of FIG. 8C, internal voltage supply 704 may be coupled to digital voltage source 708 first through a resistor 744 before passing through the LDO linear voltage regulator 716 or the PMOS 750. Resistor 744 and capacitor 746 constitute an RC filter that filters out noises, for example, noise due to the switching of PMOS 780 (see FIG. 8D). This RC filter helps reduce errors when microcontroller 720 is making analog-to-digital conversions. In the present embodiment, resistor 744 may be set at 18 Ohms, for example, while capacitor 746 may be set at 1.0 micro Farad, for example.

Microcontroller 720 can be programmed during manufacturing of a flashlight or other portable lighting device to input number of battery cell information, such as battery cell count, through cell count test point 824 (shown in FIG. 7) to decide whether to turn signal line BYPASS_LDO 734 high or low. This battery cell count information is also stored in an embedded non-volatile memory, such as EEPROM, of microcontroller 720 for determining an appropriate power profile which will be described in more detail below.

Figure 8D:
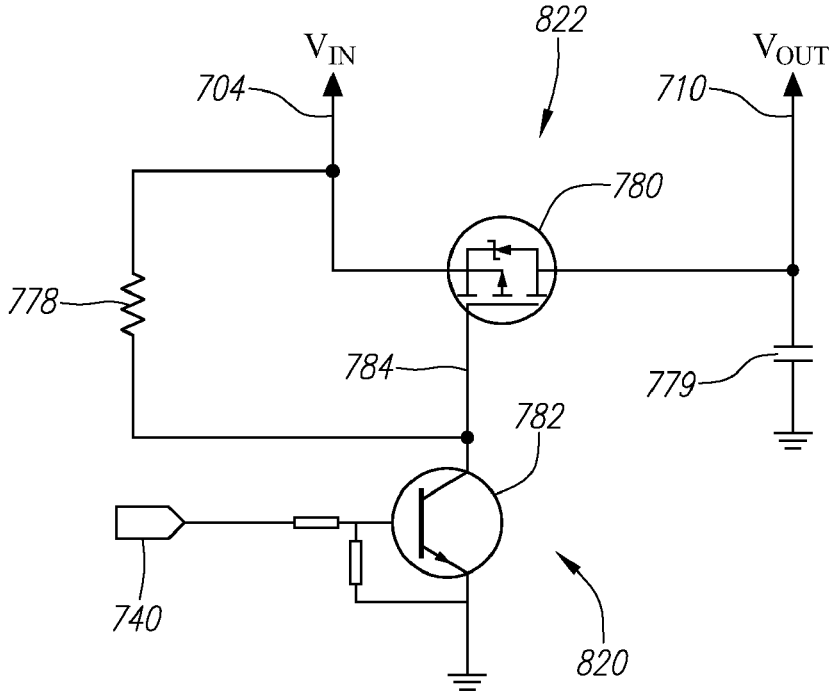

FIG. 8D shows a circuit schematic diagram of MOSFET driver circuit 820 and a load switch 822. In the embodiment of FIG. 8D, electronic load switch 822 comprises PMOS 780. The source of PMOS 780 is coupled to internal voltage supply 704 while the drain of PMOS 780 is coupled to voltage output pin 710. Voltage output pin 710 may be coupled to the positive electrode of the LED 445 of flashlight 400. The gate of PMOS 780 is coupled to a MOSFET driver 820, which is implemented by a bipolar transistor 782. The gate of PMOS 780 is also pulled-up to internal voltage supply 704 by a resistor 778. Accordingly, when the base of bipolar transistor 782 is driven high by signal LAMP_DRIVE 740, bipolar transistor 782 is closed and begins to conduct, which in turn causes PMOS 780 to close and conduct. Therefore, electric power can flow from internal voltage supply 704 to voltage output pin 710 thereby completing the circuit to power LED 445.

With the switch assembly design described above, as long as the battery pack or batteries are installed so that the cathode of the batteries of battery pack is in electrical communication with the snap in contact 474 and the anode of the batteries or battery pack is in electrical contact with the ground contact 484, the assembled circuit board 472 will be supported by power from the batteries or battery pack regardless whether the flashlight 400 is turned "on" or turned "off." By default, microcontroller 720 is in a very low power stand-by mode to minimize drain on the batteries. When momentary pad 589 is grounded by snap dome 470, microcontroller 720 wakes up from the low power stand-by mode and turns on to close the load switch 780, which in turn powers the LED 445 of the flashlight 400. As long as momentary pad 589 is grounded, the LED 445 will be in full power. Once the plunger 448 is released and momentary pad 589 is no longer grounded, microcontroller 720 will turn "off" load switch 780 and power to LED 445 will be cut off. Microcontroller 720 will then go back to low power stand-by mode.

If switch plunger 468 is pressed sufficiently hard to cause both momentary pad 589 and latch pad 588 to be grounded, the LED 445 will remain powered until another full press is detected.

Figure 8E:
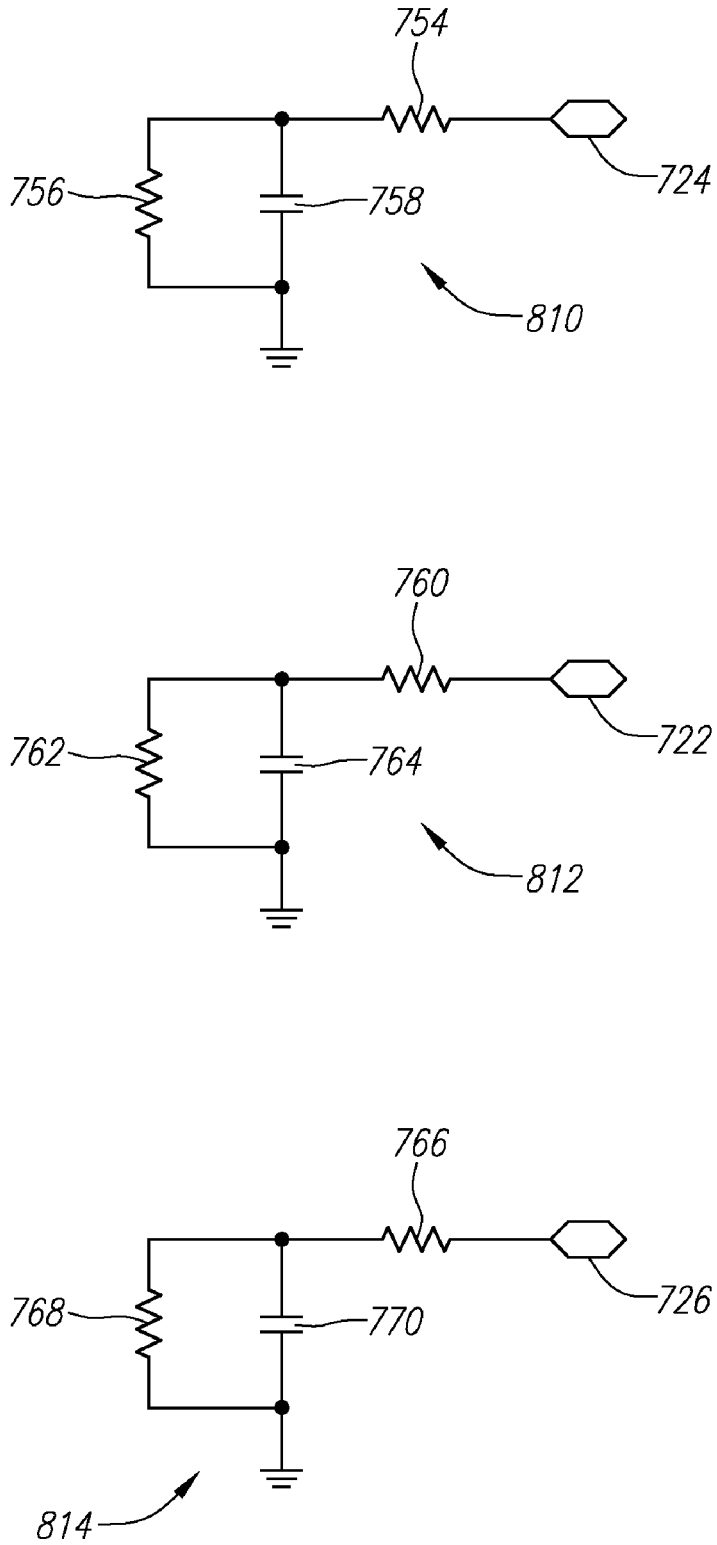

Referring to FIG. 8E, the three mode memory devices 810, 812, 814 will now be described together. The first mode memory device 810 has an input/output signal line ADC_MODE_CAP 1724 which is coupled to microcontroller 720. Signal line ADC_MODE_CAP1 724 is also coupled to one end of a charge resistor 754. The other end of resistor 754 is coupled to an RC circuit comprising a bleed off resistor 756 connected in parallel with a capacitor 758. The other end or the RC circuit is coupled to ground. This first mode memory device 810 can be used to store information in a temporary manner. Microcontroller 720 may be used to store information in mode memory device 810 by setting signal line ADC_MODE_CAP1 724 to a high or a low signal. The high signal would be stored in the first mode memory device 810 for a short period of time, for example, 2 seconds, before it is decayed sufficiently that it is no longer recognized as a high signal. Microcontroller 720 can execute a read operation from signal line ADC_MODE_CAP1 724 to retrieve data stored in the first mode memory device 810. In one embodiment, the resistance of resistor 756 is 1.0 Mega Ohms while the capacitance of capacitor 758 is 1.0 micro Farad. Similarly, the second mode memory device 812 and the third mode memory device 814 can have the same configuration as that of the first mode memory device 810.

Flashlight 400 may be provided with a variety of modes of operation. In the present embodiment, controller 808 is configured to implement eight separate modes of operation. Accordingly, when the flashlight is switched on, microcontroller 720 reads mode information from an internal memory, for example, an embedded SRAM built in the microcontroller 720. Microcontroller 720 increments the mode information by one to obtain current mode information and then stores the current mode information to the external mode memory devices 810, 812, 814. Flashlight 400 also changes to the new mode of operation accordingly.

For example, when plunger 468 is pressed sufficiently to cause snap dome 470 to deflect into the latch position while flashlight 400 is in the off mode, microcontroller 720 reads the previous mode information from the embedded SRAM. If the previous mode information is 0,0,0, microcontroller 720 increments it by one to obtain the current mode information, which is 0,0,1. In the present embodiment, a 0,0,1 mode information represent a full power mode. In accordance, flashlight 400 enters the full power mode. Microcontroller 720 then writes the current mode information into the three mode memory devices 810, 812, 814 by pulling signal lines ADC_MODE_CAP3 726 and ADC_MODE_CAP2 722 to low and pulling signal line ADC_MODE_CAP1 724 to high.

If the switch 500 is pressed sufficiently hard to cause switch assembly to enter into the latch position (both momentary pad 589 and latch pad 588 are grounded), while the flashlight 400 is in an operational mode other than the off mode, and then held for a period of time, for example, two seconds, in the present embodiment, microcontroller 720 interprets the received input as a command to change modes of operation. Microcontroller 720 reads the previous mode information from the embedded SRAM and increments it by one to obtain the new current mode information. If the previous mode information is 0,0,1, for example, then the new current mode information would be 0,1,0. Microcontroller 720 then writes the new current mode information into the three mode memory devices 810, 812, 814 by pulling signal lines ADC_MODE_CAP3 726 and ADC_MODE_CAP1 724 to low and pulling signal line ADC_MODE_CAP2 722 to high. In the present embodiment, this 0,1,0 combination represents a 50% power save mode.

In the present embodiment, an 0,1,1 combination stored in the three mode memory devices 810, 812, 814 represents that the current mode is a 25% Power Save mode. The rest of the operational modes for flashlight 400 are shown in Table 1.

TABLE 1

Operation Modes and Code

| | Mode Name | |
|---|---|---|
| | Current mode | Next mode |
| Off | 0, 0, 0 | 0, 0, 1 |
| Full Power | 0, 0, 1 | 0, 1, 0 |
| 50% Power Save | 0, 1, 0 | 0, 1, 1 |
| 25% Power Save | 0, 1, 1 | 1, 0, 0 |
| 10% Power Save | 1, 0, 0 | 1, 0, 1 |
| Blink | 1, 0, 1 | 1, 1, 0 |
| Beacon | 1, 1, 0 | 1, 1, 1 |
| SOS | 1, 1, 1 | 1, 1, 1 |

As long as the user continues to hold the switch 500 in the latch position, the flashlight 400 will transition through the lists of modes above. Every time a predetermined period of time, for example, two seconds, passes, the mode count will be incremented.

Flashlight 400 may face a power interruption while the flashlight 400 is turned on or turned off. For example, when there is a need for battery replacement, flashlight 400 (and also the microcontroller 720) could experience a relatively long period of power interruption. When the flashlight is accidentally dropped on the ground or hit against a hard surface from one of its ends, the inertia of the batteries or battery pack could cause the batteries or battery pack which is sufficient to disconnect from one of the battery contacts for a short period of time, which is sufficient to cause a short period of power interruption to the controller 808.

In the present embodiment, after flashlight 400 has experienced a power interruption, no matter if it is a relatively long period or a short period, when the power is turned back on, microcontroller 720 runs a power up routine, which includes reading from the voltages stored on the three mode memory devices 810, 812, 814 through signal lines ADC_MODE_CAP3 726, ADC_MODE_CAP2 722, ADC_MODE_CAP1 724. Accordingly, flashlight 400 enters the mode indicated by the mode memory devices 810, 812, 814.

For example, after a battery replacement, the mode information indicated by the mode memory devices 810, 812, 814 should be 0,0,0 since the charge stored on each of capacitors 758, 764, 770 should have decayed by the time microcontroller 720 is again powered. Microcontroller 720 then reads from the three mode memory devices 810, 812, 814 and obtains 0,0,0 as the previous mode information. Accordingly, flashlight 400 enters the off mode.

On the other hand, if the flashlight is accidentally dropped on the ground or is hit against a hard surface from one of its ends, the inertia of the batteries or battery pack could cause the batteries or battery pack to disconnect from one of the battery contacts for a short period of time, which is sufficient to cause a short period of power interruption of typically shorter than 0.5 seconds to the controller 808. If the mode of operation right before the power interruption was, for example, the SOS mode, the charge, after the short power interruption, stored on each of capacitors 758, 764, 770 would continue to be retained until sufficiently after power is restored that microcontroller 720 will read 1,1,1 when it reads from the three mode memory devices 810, 812, 814. Accordingly, flashlight 400 will enter the SOS mode, which was the operating mode before the power interruption. In other words, the flashlight 400 has immunity from such temporary power interruptions, due to accidental droppings of the flashlight or otherwise.

The power immunity from interruption of flashlight 400 also applies to the condition when the flashlight 400 is in the off mode. When the flashlight 400 is switched off, microcontroller 720 writes 0,0,0 to the three mode memory devices 810, 812, 814, and microcontroller 720 enters a low power stand-by mode. Therefore, regardless of whether a short power interruption or a long power interruption is experienced, after the power is restored, microcontroller 720 will read from the three mode memory devices 810, 812, 814 and obtain 0,0,0 as the previous mode information. Accordingly, flashlight 400 will enter the off mode.

Figure 9:
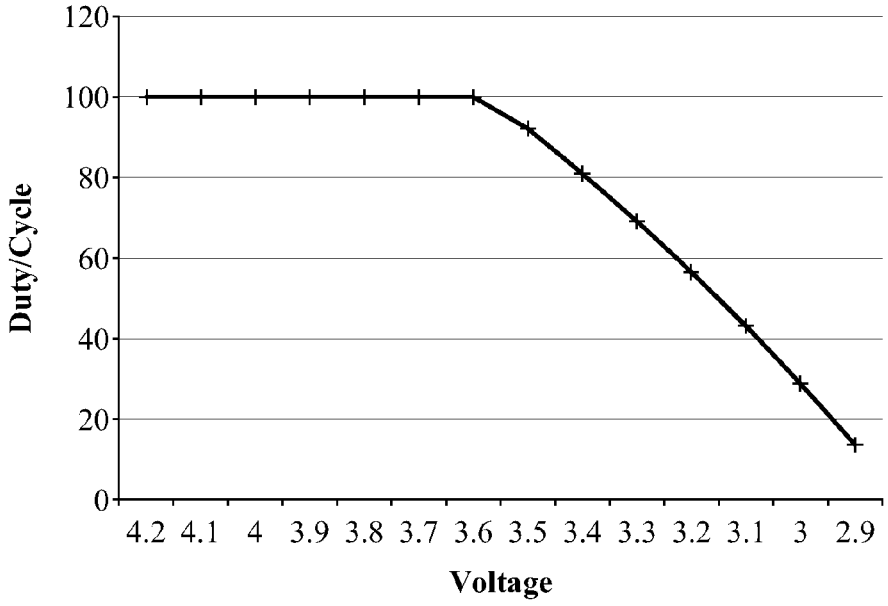
FIG. 9 is a power profile diagram.

The electronic switch 822 is preferably controlled by controller 808 to supply power to LED 445 at different duty cycles to maximize battery life over a discharge cycle. Microcontroller 720 includes an internal memory for storing data concerning battery count information and the power profile such as included in FIG. 9 for batteries or a battery pack that can be installed in flashlight 400. As seen in FIG. 9, for most of the battery life, electronic switch 822 provides full power (100% duty cycle) to LED 445. As the batteries are depleted, however, battery voltage 702 will drop which is monitored by microcontroller 720. Microcontroller 720 uses the power profile stored in memory for a particular battery arrangement to determine when to reduce the duty cycle and when to maintain it at 100%.

Each battery arrangement has a corresponding power map that includes at least a high voltage period and a voltage depletion period. Some battery arrangements, particularly for dry cell batteries, may also include a plateau region at the low voltage end of the power profile, corresponding to a constant low voltage period. When battery voltage 702 is in the high voltage period, microcontroller 720 provides a high duty cycle signal, typically 100%, to the lamp drive output pin 740 for MOSFET driver 820 to provide a power supply 710 to LED 445 with a high duty cycle. When battery voltage 702 is in the voltage depletion period, microcontroller 720 gradually declines the duty cycle signal to the lamp drive output pin 740 for MOSFET driver 820 to provide a declining power supply 710 to LED 445 with a gradually declining duty cycle. In battery arrangements that have a power profile that includes a low voltage plateau period, then when battery voltage 702 detects the low voltage period, microcontroller 720 provides a generally constant low duty cycle signal to the lamp drive output pin 740 for MOSFET driver 820 to provide a power supply 710 to LED 445 with a generally constant low duty cycle. FIG. 9 is a power profile for battery pack 501. By controllably reducing the duty cycle towards the end of a battery pack or a battery's life as set forth herein, the usable life time of battery pack or the battery can be significantly extended.

While various embodiments of an improved flashlight and its respective components have been presented in the foregoing disclosure, numerous modifications, alterations, alternate embodiments, and alternate materials may be contemplated by those skilled in the art and may be utilized in accomplishing the various aspects of the present invention. For example, the power control circuit and short protection circuit described herein may be employed together in a flashlight or may be separately employed. Further, the short protection circuit may be used in rechargeable electronic devices other than flashlights. Thus, it is to be clearly understood that this description is made only by way of example and not as a limitation on the scope of the invention as claimed below.

What is claimed:

1. A flashlight comprising:

a portable power source housed in a rear barrel portion;

a light source having a positive electrode and a negative electrode;

a switch assembly that is electrically connected to the portable power source and that is located between the portable power source and the light source;

a first spring located between the light source and the portable power source for forming a first portion of a first electrical path between the positive electrode of the light source and the portable power source;

a second spring located between the light source and the portable power source for forming a first portion of a second electrical path between the negative electrode of the light source and the portable power source; and a front barrel portion that is axially aligned with the rear barrel portion and that extends at least partially between the light source and switch assembly, wherein the front barrel is not within the first electrical path or the second electrical path.

2. The flashlight of claim 1, further comprising an adjustable ball housing that is at least partially contained within the front barrel portion, that forms a second portion of the second electrical path and that holds the light source and allows adjustment of the light source.

3. The flashlight of claim 1, wherein the second spring is a spring probe.

4. The flashlight of claim 1, wherein the light source is an LED.

5. The flashlight of claim 1, wherein the second spring is a leaf spring.

6. A flashlight comprising:

a main power circuit including a portable power source housed in a rear barrel portion, a switch assembly and a light source, wherein the switch assembly is electrically coupled to the portable power source and is located between the portable power source and the light source;

a first spring within the main power circuit between the portable power source and the light source, the first spring electrically connecting the positive electrode of the light source and the switch assembly;

a second spring within the main power circuit between the portable power source and the light source, the second spring electrically connecting the negative electrode of the light source and the switch assembly; and a front barrel portion that is axially aligned with the rear barrel and that is connected to the switch assembly, wherein the front barrel portion does not form part of the main power circuit.

7. The flashlight of claim 6, further comprising a ball within the main power circuit, wherein the light source is held by the ball.

8. The flashlight of claim 7, wherein the outer circumference of the ball has an array of fin-like protrusions for effectively dissipating heat from the light source.

9. The flashlight of claim 6, wherein the second spring is a spring probe.

10. The flashlight of claim 6, wherein the light source is an LED.

11. The flashlight of claim 6, wherein the second spring is a leaf spring.

12. An adjustable ball assembly for portable lighting devices comprising:

a metal tubular ball housing having a forward end, a rearward end, and a slot on the rearward end;

a ball assembly fit within the forward end of the metal tubular ball housing, wherein the ball assembly has an annular hollow region;

a lighting module having a positive contact, wherein the lighting module is partially fit within the ball assembly;

a retainer fit within the rearward end of the metal tubular ball housing, wherein the retainer has an annular channel region smaller in diameter than that of the annular hollow region of the ball assembly, and a funnel spring having a head and a tail, wherein the diameter of the head of the funnel spring is larger than the annular channel region of the retainer, wherein the tail of the funnel spring is fit within the annular channel region of the retainer, wherein when the retainer is fit within the rearward end of the metal tubular ball housing, the funnel spring is secured by the retainer.

13. The adjustable ball assembly of claim 12, wherein the ball assembly has an adjusting ring partially inserted into the slot of the metal tubular ball housing for adjusting the lighting module relative to a principal axis of a reflector.

14. The adjustable ball assembly of claim 12, wherein the annular hollow region of the ball assembly has a reduced inner diameter toward the forward end of the ball housing.

15. The adjustable ball assembly of claim 12, wherein the annular channel region of the retainer has an enlarged inner diameter toward the forward end of the ball housing.

16. The adjustable ball assembly of claim 12, wherein the head of the funnel spring is in electrical contact with the positive contact of the lighting module through a contact cup.

17. The adjustable ball assembly of claim 12, further comprising a cup-shaped insulator having a hole on its bottom, wherein the funnel spring is secured by the retainer and the insulator.

18. The adjustable ball assembly of claim 12, wherein the ball has spherical surfaces at locations where the ball interfaces with the metal tubular housing and the retainer.

19. The adjustable ball assembly of claim 18, wherein the metal tubular housing and the retainer have angled surfaces at their interfaces with the ball.

20. An adjustable ball assembly for portable lighting devices comprising:

a metal tubular ball housing having a forward end, a rearward end, and a slot on the rearward end;

a ball assembly having an annular hollow region, wherein the ball assembly is slideably fit within the forward end of the metal tubular ball housing;

a lighting module having a positive contact, wherein the lighting module is partially fit within the adjustable ball assembly;

a retainer having a through hole and a front open mouth, wherein the diameter of the front open mouth is smaller than that of the annular hollow region of the ball assembly, wherein the retainer is fit within the rearward end of the metal tubular ball housing so that the front open mouth of the retainer defines a rear-most position;

an insulator located between the lighting module and the retainer, wherein the insulator has a cup-shaped receiving area, and the receiving area defines a front-most position; and a funnel spring having a head and a tail, wherein the diameter of the head of the funnel spring is larger than the front open mouth of the retainer and smaller than the receiving area of the insulator, and wherein the head of the funnel spring is confined between the front-most position and the rear-most position.

* * * * *